US011764046B2

(12) United States Patent
Cooks et al.

(10) Patent No.: US 11,764,046 B2
(45) Date of Patent: Sep. 19, 2023

(54) PRECURSOR AND NEUTRAL LOSS SCAN IN AN ION TRAP

(71) Applicant: Purdue Research Foundation, West Lafayette, IN (US)

(72) Inventors: Robert Graham Cooks, West Lafayette, IN (US); Dalton Snyder, West Lafayette, IN (US); Christopher Pulliam, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 17/730,830

(22) Filed: Apr. 27, 2022

(65) Prior Publication Data

US 2022/0254620 A1 Aug. 11, 2022

Related U.S. Application Data

(63) Continuation of application No. 15/772,738, filed as application No. PCT/US2016/059982 on Nov. 2, 2016, now Pat. No. 11,348,778.

(60) Provisional application No. 62/321,903, filed on Apr. 13, 2016, provisional application No. 62/249,688, filed on Nov. 2, 2015.

(51) Int. Cl.
*H01J 49/00* (2006.01)
*H01J 49/42* (2006.01)

(52) U.S. Cl.
CPC ..... *H01J 49/0081* (2013.01); *H01J 49/424* (2013.01)

(58) Field of Classification Search
CPC .. H01J 49/0081; H01J 49/424; H01J 49/4245; H01J 49/422; H01J 49/427; H01J 49/4285; H01J 49/4275; H01J 49/429
See application file for complete search history.

(56) References Cited

U.S. PATENT DOCUMENTS

| | | | |
|---|---|---|---|
| 2,939,952 | A | 6/1960 | Steinwedel |
| 4,749,860 | A | 6/1988 | Kelley et al. |
| 5,075,547 | A | 12/1991 | Johnson et al. |
| 5,128,542 | A | 7/1992 | Yates et al. |

(Continued)

FOREIGN PATENT DOCUMENTS

| | | |
|---|---|---|
| WO | 2009/023361 A3 | 5/2009 |
| WO | 2009/102766 A1 | 8/2009 |
| WO | 2015/023480 A1 | 2/2015 |

OTHER PUBLICATIONS

Alfred, 1993, Resonance excitation of ions stored in a quadrupole ion trap. Part IV. Theory of quadrupolarexcitation, Int. J. Mass Spectrom. Ion Processes, 125:171.

(Continued)

*Primary Examiner* — David E Smith
(74) *Attorney, Agent, or Firm* — Brown Rudnick LLP; Adam M. Schoen

(57) ABSTRACT

The invention generally relates to systems and methods for precursor and neutral loss scan in an ion trap. In certain aspects, the invention provides a system that includes a mass spectrometer having an ion trap, and a central processing unit (CPU). The CPU includes storage coupled to the CPU for storing instructions that when executed by the CPU cause the system to excite a precursor ion and eject a product ion in the single ion trap.

3 Claims, 25 Drawing Sheets

(56) References Cited

U.S. PATENT DOCUMENTS

| | | | | |
|---|---|---|---|---|
| 5,171,991 | A * | 12/1992 | Johnson | H01J 49/0081 250/282 |
| 5,291,017 | A | 3/1994 | Wang | |
| 5,352,890 | A | 10/1994 | Johnson et al. | |
| 5,644,131 | A | 7/1997 | Hansen | |
| 5,714,755 | A | 2/1998 | Wells et al. | |
| 6,147,348 | A | 11/2000 | Quarmby et al. | |
| 6,469,298 | B1 | 10/2002 | Ramsey et al. | |
| 6,838,666 | B2 | 1/2005 | Ouyang et al. | |
| 7,193,207 | B1 | 3/2007 | Ding et al. | |
| 7,335,897 | B2 | 2/2008 | Takats et al. | |
| 8,227,751 | B2 | 7/2012 | Green | |
| 8,304,718 | B2 | 11/2012 | Ouyang et al. | |
| 9,157,921 | B2 | 10/2015 | Cooks et al. | |
| 11,348,778 | B2 * | 5/2022 | Cooks | H01J 49/0081 |
| 2003/0085349 | A1 | 5/2003 | Kato | |
| 2003/0183759 | A1 | 10/2003 | Schwartz et al. | |
| 2004/0159785 | A1 | 8/2004 | Kato | |
| 2005/0045816 | A1 | 3/2005 | Yamaguchi et al. | |
| 2005/0061966 | A1 | 3/2005 | Ding et al. | |
| 2005/0067564 | A1 | 3/2005 | Douglas et al. | |
| 2006/0163472 | A1 | 7/2006 | Marquette | |
| 2006/0219888 | A1 | 10/2006 | Jachowski et al. | |
| 2006/0219898 | A1 | 10/2006 | McLuckey et al. | |
| 2007/0057175 | A1 | 3/2007 | Mordehai et al. | |
| 2007/0181803 | A1 | 8/2007 | Hasegawa et al. | |
| 2008/0001083 | A1 | 1/2008 | Schaefer et al. | |
| 2008/0078927 | A1 | 4/2008 | Guna | |
| 2008/0217527 | A1 | 9/2008 | Wang | |
| 2009/0283675 | A1 | 11/2009 | Franzen | |
| 2011/0121172 | A1 | 5/2011 | Savitski | |
| 2011/0240849 | A1 | 10/2011 | Wright | |
| 2011/0278917 | A1 | 11/2011 | Vandermey et al. | |
| 2011/0315866 | A1 | 12/2011 | Mitchell et al. | |
| 2012/0119079 | A1 | 5/2012 | Ouyang et al. | |
| 2012/0267526 | A1 | 10/2012 | Green | |
| 2012/0326026 | A1 | 12/2012 | Misharin et al. | |
| 2013/0221233 | A1 | 8/2013 | Whitehouse et al. | |
| 2013/0248704 | A1 | 9/2013 | Kenny | |
| 2013/0273560 | A1 | 10/2013 | Cooks et al. | |
| 2014/0246576 | A1 | 9/2014 | Gilbert et al. | |
| 2014/0264001 | A1 | 9/2014 | Ramsey et al. | |
| 2015/0303047 | A1 | 10/2015 | Jiang et al. | |
| 2015/0380232 | A1 | 12/2015 | Brown et al. | |
| 2016/0035552 | A1 | 2/2016 | Verenchikov | |
| 2016/0293393 | A1 | 10/2016 | Gordon et al. | |
| 2016/0365231 | A1 | 12/2016 | Xu et al. | |
| 2017/0133214 | A1 | 5/2017 | Rafferty et al. | |
| 2017/0140915 | A1 | 5/2017 | Xu | |
| 2017/0221695 | A1 | 8/2017 | Cooks et al. | |
| 2018/0114686 | A1 | 4/2018 | Cooks et al. | |
| 2018/0204714 | A1 | 7/2018 | Cooks et al. | |
| 2018/0342382 | A1 | 11/2018 | Cooks et al. | |
| 2019/0013194 | A1 | 1/2019 | Dang et al. | |
| 2019/0035614 | A1 | 1/2019 | Cooks et al. | |
| 2019/0035619 | A1 | 1/2019 | Cooks et al. | |

OTHER PUBLICATIONS

Austin, 2007, Halo Ion Trap Mass Spectrometer, Anal. Chem., 79:2927-2932.

Blain, 2004, Towards the Hand-Held Mass Spectrometer: Design Considerations, Simulation and Fabrication of Micrometer-scaled Cylindrical Ion Traps, Int. J. Mass Spectrom., 236:91-104.

Bonner, 1977, The Cylindrical Ion Trap, International Journal of Mass Spectrometry and Ion Physics, 24(3):255-269.

Carroll, 1975, Atmospheric Pressure Ionization Mass Spectrometry: Corona Discharge Ion Source for Use in Liquid Chromatograph-Mass Spectrometer-Computer Analytical System, Anal. Chem. 47:2369-2373.

Cody, 2005, Versatile New Ion Source for the Analysis of Materials in Open Air under Ambient Condition, Anal Chem., 77:2297-2302.

Ding, 2004, A digital ion trap mass spectrometer coupled with atmospheric pressure ion sources, J. Mass Spectrom, 39:471-484.

Fenn, 1989, Electrospray Ionization for Mass Spectrometry of Large Biomolecules, Science 246:64-71.

Gao, 2008, Design and Characterization of a Multisource Hand-Held Tandem Mass Spectometer, Anal. Chem., 80:7198-7205.

Hagar, 2002, A new linear ion trap mass spectromer, Rapid Communi. Mass Spectrometry, 16(6):512-526.

Hendricks, 2014, Autonomous in-situ analysis and real-time chemical detection using a backpack miniature mass spectrometer: concept, instrumentation development, and performance, Anal. Chem., 86:2900-2908.

Hou, 2011, Sampling Wand for an Ion Trap Mass Spectrometer, Anal. Chem., 83:1857-1861.

Hughes-Fulford M, Chen YF, Tjandrawinata RR: Fatty acid regulates gene expression and growth of human prostate cancer PC-3 cells. Carcinogenesis 2001, 22(5):701-707.

International Preliminary Report on Patentability, International Search Report and Written Opinion for Application No. PCT/US1659982, 9 pages.

Kaiser, 1991, Operation of a Quadrupole Ion Trap Mass-Spectrometer to Achieve High Mass Charge Ratios, Int. J. Mass Spectrom. Ion Processes, 106:79-115.

Kogelschatz, 2003, Dielectric-barrier Discharges: Their History, Discharge Physics, and Industrial Applications, Plasma Chem. and Plasma Processing, 23:1-46.

Kondrat, 1978, Multiple Reaction Monitoring in Mass Spectrometry Mass Spectrometry for Direct Analysis of Complex-Mixtures. Analytical Chemistry, 50(14):2017-2021.

Laiko, 2000, Atmospheric pressure matrix-assisted laser desorption/ionization mass spectrometry, Anal. Chem., 72:652-657.

Landais, 1998, Varying the Radio Frequency: a New Scanning Mode for Quadrupole Analyzers, Rapid Commun. Mass Spectrom, 12:302-306.

Li, 2014, Miniature Ambient Mass Analysis System, Anal. Chem., 86:2909-2916.

Mar. 1997, An Introduction to Quadrupole Ion Trap Mass Spectrometry, J. Mass Spectrom, 32:351-369.

Moxom, 2002, Double resonance ejection in a micro ion trap mass spectrometer, Rapid Commun Mass Spectrom, 16:755-760.

Nie, 2008, Calibration of a frequency-scan quadrupole ion trap mass spectrometer for microparticle mass analysis, Int. J. Mass Spectrom., 270:8-15.

Paul, 2014, Autonomous in Situ analysis and Real-Time Chemical Detection Using a Backpack Miniature Mass SPectrometer: concept, Instrumentation Development, and Performance, Anal. Chem., 86:2900-2908.

Picotti, 2012, Selected reaction monitoring-based proteomics: workflows, potential, pitfalls and future directions, Nat Methods, 9(6):555-66.

Shiea, 2005, Electrospray-assisted laser desorption/ionization mass spectrometry for direct ambient analysis of solids, J. Rapid Comm in Mass Spectrometry, 19:3701-3704.

Snyder, 2016, Experimental Characterization of Secular Frequency Scanning in an Ion Trap, J. Am. Soc. Mass Spectrom 27:1243-1255.

Sokol, 2011, Miniature mass spectrometer equipped with electrospray and desorption electrospray ionization for direct analysis of organics from solids and solutions, Int. J. Mass Spectrum. 306:187-195.

Stafford, 1984, Recent Improvements in and Analytical Applications of Advanced Ion Trap Technology, Int. J. Mass Spectrom Ion Processes, 60:85-98.

Takats, 2004, Mass Spectrometry Sampling Under Ambient Conditions with Desoprtion Electrospray Ionization, Science 306:471-473.

Tanaka, 1988, Protein and Polymer Analyses up to m/z 1000000 by Laser Ionization Time-of-flight Mass Spectrometry, Rapid Commun. Mass Spectrom., 2:151-153.

Yamashita, 1984, Electrospray Ion Source. Another Variation on the Free-Jet Theme, J. Phys. Chem., 88:4451-4459.

* cited by examiner

| Precursor m/z | Product m/z |
|---|---|
| **242** | 142, 186 |
| **285** | 200, 268 |
| **355** | 128, 186, 198, 270 |
| **411** | 142, 214, 226, 312 |
| **467** | 156, 242, 254, 354 |

FIG. 6

PRECURSOR AND NEUTRAL LOSS SCAN IN AN ION TRAP

RELATED APPLICATIONS

The present application is a continuation of U.S. nonprovisional application Ser. No. 15/772,738, filed May 1, 2018, which is a 35 U.S.C. § 371 national phase application of PCT/US16/59982, filed Nov. 2, 2016, which claims the benefit of and priority to U.S. provisional application Ser. No. 62/321,903, filed Apr. 13, 2016, and U.S. provisional application Ser. No. 62/249,688, filed Nov. 2, 2015, the content of each of which is incorporated by reference herein in its entirety.

GOVERNMENT INTEREST

This invention was made with government support under NNX16AJ25G awarded by the National Aeronautics and Space Administration, NNX12AB16G awarded by the National Aeronautics and Space Administration, and CHE 1307264 awarded by the National Science Foundation. The government has certain rights in the invention.

FIELD OF THE INVENTION

The invention generally relates to systems and methods for precursor and neutral loss scans in an ion trap.

BACKGROUND

Quadrupole ion traps are one of the main types of mass analyzers employed in mass spectrometry. They are compact devices that are relatively inexpensive and they provide mass spectra with adequate resolution to separate ions differing by 1 Da in mass at unit charge. These systems are widely used due to their pressure tolerance, high sensitivity and resolution, and capabilities for single analyzer product ion scans. However, single quadrupole ion traps cannot perform useful precursor and neutral loss scans.

Typically, triple quadrupole mass spectrometers are employed to perform precursor and neutral loss scans. A triple quadrupole mass spectrometer (TQMS) is a tandem mass spectrometer consisting of two quadrupole mass analyzers in series, with a (non-mass-resolving) radio frequency (RF)-only quadrupole between them to act as a cell for collision-induced dissociation. However, triple quadrupole mass spectrometers are cost prohibitive large instruments that are only suitable for use in a laboratory. Such instruments also have demanding pumping requirements to maintain the necessary vacuum pressure in each of the mass analyzers.

SUMMARY

The invention provides systems and methods in which precursor and neutral loss scans can be performed in a single ion trap, such as a single quadrupole ion trap. Aspects of the invention may be accomplished by applying multiple resonant signals that interact with the precursor and product ions in a manner that the interactions cause excitation and hence dissociation or excitation and hence ejection and detection, the outcome depending on the amplitude and timing of application of the signals.

Certain aspects of the invention may be accomplished by exciting precursor ions at a constant alternating current (AC) frequency (constant Mathieu q value) and ramping a radio frequency (RF) signal in either the forward or reverse direction, thereby fragmenting all ions at an optimally chosen q value. In certain embodiments, that AC signal may include two supplementary AC signals applied orthogonally (e.g. AC1 in x and AC2 in y). Simultaneously, a particular product m/z may be ejected from the trap by including a second frequency corresponding to this product ion. This frequency changes as a function of time because the RF amplitude is being ramped, so the ejection is a secular frequency scan at constant m/z. That is, instead of exciting at variable frequency and ejecting at constant frequency, excitation is performed at constant frequency and ejection takes place at a variable frequency. Neutral loss scans can similarly be performed by instead scanning the product frequency at a constant mass offset from the precursor ion. The process is procedurally the same as the precursor scan, but the scan rate of the product ejection waveform is different (scanned through different masses rather than scanned along with one mass).

Another approach to accomplish aspects of the invention involves exciting precursor ions using a constant RF signal and an AC signal that varies as a function of time. In certain embodiments, that AC signal may include two supplementary AC signals that are in resonance with the secular frequencies of the ions of interest. The two AC signals may be combined into a single complex waveform and applied as a single complex waveform which can either be constant over the time of application (giving SRM data) or varied over time as a result of varying one of both of the component frequencies (giving precursor or neutral loss scans, respectively). For example, both Ac signals can be applied orthogonally (e.g. AC1 in x and AC2 in y).

Accordingly, the invention provides systems that include a mass spectrometer having an ion trap, and a central processing unit (CPU). The CPU includes storage coupled to the CPU for storing instructions that when executed by the CPU cause the system to excite a precursor ion, optionally as a function of time, and eject a product ion in the single ion trap. In certain embodiments, both excitation of the precursor ion and ejection of the product ion occur simultaneously.

Numerous approaches may be used to excite the precursor ion. In certain embodiments, the precursor ions are excited sequentially through application of two signals to the single ion trap. For example, a first signal is a constant alternating current (AC) signal, and a second signal is a radio frequency (RF) signal, which optionally varies as a function of time. In certain embodiments, that AC signal may include two supplementary AC signals applied orthogonally (e.g. AC1 in x and AC2 in y). The radio frequency (RF) signal may be varied in a forward direction (increasing with time) or a reverse direction (decreasing with time). Ejection of the product ion then occurs through simultaneous application of a third signal to the ion trap. The third signal may include a variable frequency that results in ejection of the corresponding product ion from the ion trap. In certain embodiments, the product ion has a neutral loss and the third signal is configured to scan a frequency at a rate that corresponds to a constant mass offset (the neutral loss) from the precursor ion.

In other embodiments, a first signal is a constant radio frequency (RF), and a second signal is a first alternating current (AC) signal that varies as a function of time. In certain embodiments, the frequency of the first AC signal varies as a function of time. In other embodiments, an amplitude of the first AC signal varies as a function of time. Typically, the first AC signal is in resonance with a secular frequency of ions trapped within the ion trap. In certain embodiments, the first AC signal is in resonance with a secular frequency of ions of more than one mass/charge ratio trapped within the ion trap. In certain embodiments, that AC signal may include two supplementary AC signals applied orthogonally (e.g. AC1 in x and AC2 in y).

Any ion trap can be used in systems of the invention. Exemplary ion traps include a hyperbolic ion trap, a cylindrical ion trap, a linear ion trap, and a rectilinear ion trap, that is both conventional 3D ion traps and various forms of ion traps in which the quadrupole field is in 2D. In certain embodiments of systems of the invention the mass spectrometer is a miniature mass spectrometer. The proposed scan modes are particularly well suited for use in miniature mass spectrometers because simplified and less expensive electronics are especially desirable in the cost-, weight-, and power-constrained system of a miniature mass spectrometer. However, the main advantage is that those MS/MS scans that until now have required multiple mass analyzers (viz. all MS/MS scans except for the product ion spectrum) can now be performed in a single-analyzer system.

Mass spectrometers in systems of the invention typically include a single detector. In certain embodiments, the detector is positioned to receive ions orthogonally ejected from the ion trap. In other embodiments, the mass spectrometer includes two detectors, positioned orthogonally to each other. One orthogonal detector can be used to monitor the excitation of a precursor ion to the point where its ejection from the trap begins and the other to monitor the ejection of a product ion by application of a second dipolar field in an orthogonal direction (x vs. y) so that it causes ejection and detection of fragment ions. If the AC frequency in the second signal is scanned, a product ion spectrum will be recorded with fixed first frequencies. If the first AC frequency is scanned and the second fixed a precursor scan will be recorded. If both are fixed an SRM signal will be recorded. If both are scanned, a constant neutral loss spectrum can be recorded. The advantage of the two orthogonal detector system is that interference by ejection of ions activated in the first stage of the experiment is minimized.

In certain embodiments, the systems of the invention include an ionizing source, which can be any type of ionizing source known in the art.

Other aspects of the invention provide methods for operating an ion trap. Such methods may involve applying at least two signals to a single ion trap in a manner that excites a precursor ion and ejects a product ion in the single ion trap. In certain embodiments, both the excitation of the precursor ion and the ejection of the product ion occur simultaneously. In certain embodiments, a first signal is a constant alternating current (AC) signal, and a second signal is a radio frequency (RF) signal, which optionally varies as a function of time. In certain embodiments, that AC signal may include two supplementary AC signals applied orthogonally (e.g. AC1 in x and AC2 in y). The radio frequency (RF) signal may be varied in a forward direction (increasing with time) or a reverse direction (decreasing with time). Ejection of the product ion then occurs through simultaneous application of a third signal to the ion trap. The third signal may include a variable frequency that results in ejection of the corresponding product ion from the ion trap. In certain embodiments, the product ion has a neutral loss and the third signal is configured to scan a frequency at a rate that corresponds to a constant mass offset (the neutral loss) from the precursor ion.

In other embodiments, a first signal is a constant radio frequency (RF), and a second signal is a first alternating current (AC) signal that varies as a function of time. In certain embodiments, the frequency of the first AC signal varies as a function of time. In other embodiments, an amplitude of the first AC signal varies as a function of time. Typically, the first AC signal is in resonance with a secular frequency of ions trapped within the ion trap. In certain embodiments, the first AC signal is in resonance with a secular frequency of ions of more than one mass/charge ratio trapped within the ion trap. In certain embodiments, that AC signal may include two supplementary AC signals applied orthogonally (e.g. AC1 in x and AC2 in y).

Another aspect of the invention provides methods for analyzing a sample. The methods involve ionizing a sample to generate precursor ions that are introduced into a single ion trap of a mass spectrometer. At least two signals are applied to the single ion trap in a manner that excites at least one of the precursor ions and ejects a product ion in the single ion trap. Ejected product ions from the ion trap are received at a detector where the product ions are analyzed.

In certain embodiments, both the excitation of the precursor ion and the ejection of the product ion occur simultaneously. In certain embodiments, a first signal is a constant alternating current (AC) signal, and a second signal is a radio frequency (RF) signal, which optionally varies as a function of time. In certain embodiments, that AC signal may include two supplementary AC signals applied orthogonally (e.g. AC1 in x and AC2 in y). The radio frequency (RF) signal may be varied in a forward direction (increasing with time) or a reverse direction (decreasing with time). Ejection of the product ion then occurs through simultaneous application of a third signal to the ion trap. The third signal may include a variable frequency that results in ejection of the corresponding product ion from the ion trap. In other embodiments, a first signal is a constant radio frequency (RF), and a second signal is a first alternating current (AC) signal that varies as a function of time. In certain embodiments, the frequency of the first AC signal varies as a function of time. In other embodiments, an amplitude of the first AC signal varies as a function of time. In certain embodiments, that AC signal may include two supplementary AC signals applied orthogonally (e.g. AC1 in x and AC2 in y).

The sample may be any sample, such as a biological sample, an industrial sample, an environmental sample, or an agricultural sample. In the case of biological samples, a disease may be diagnosed based on the results of the analysis.

BRIEF DESCRIPTION OF THE DRAWINGS

FIG. 6 is a table showing the MS/MS space of five tetraalkylammonium ions (tetrabutylammonium (m/z 242), hexadecyltrimethylammonium (m/z 284), tetrahexylammonium (m/z 355), tetraoctylammonium (m/z 467), and tetraheptylammonium (m/z 411)).

In FIG. 9 panel A, two waveforms of differing frequencies (precursor frequency and product frequency) are applied to the trap to excite the former and eject the latter. In FIG. 9 panel B, one waveform's frequency is swept while the other is fixed on a product ion of interest. In the neutral loss scan provided in FIG. 9 panel C, the two waveforms' frequencies are swept at different rates so as to keep a constant mass offset between them. The time sequence (for example, if there is a time offset in panel A) of the two signals can be optimized through simulations and experiment.

FIG. 11A: using a miniature rectilinear ion trap mass spectrometer (Mini 12) compared with FIG. 11B: simulated AC frequency scan data FIG. 11C: RF scan resonance ejection data for the same instrument and FIG. 11D: RF scan resonance ejection data for a commercial LTQ instrument. Note that the forward AC frequency scan reverses the mass/charge order.

FIG. 12A: a second signal of fixed frequency, FIG. 12B: a second signal of a different fixed frequency, and FIG. 12C: where no second signal was applied. No signal was seen during scan in FIG. 12A when the constant fixed frequency AC signal was set off resonance. The precursor ion spectrum was seen in FIG. 12B where the variable AC signal swept through m/z 304 and the fixed AC was set on a product of m/z 304 (the product ion being m/z 182), viz. on resonance case. In case of FIG. 12C no second frequency was used and instead the AC frequency scan with a higher amplitude gave the simple mass spectrum.

DETAILED DESCRIPTION

Figure 1A:
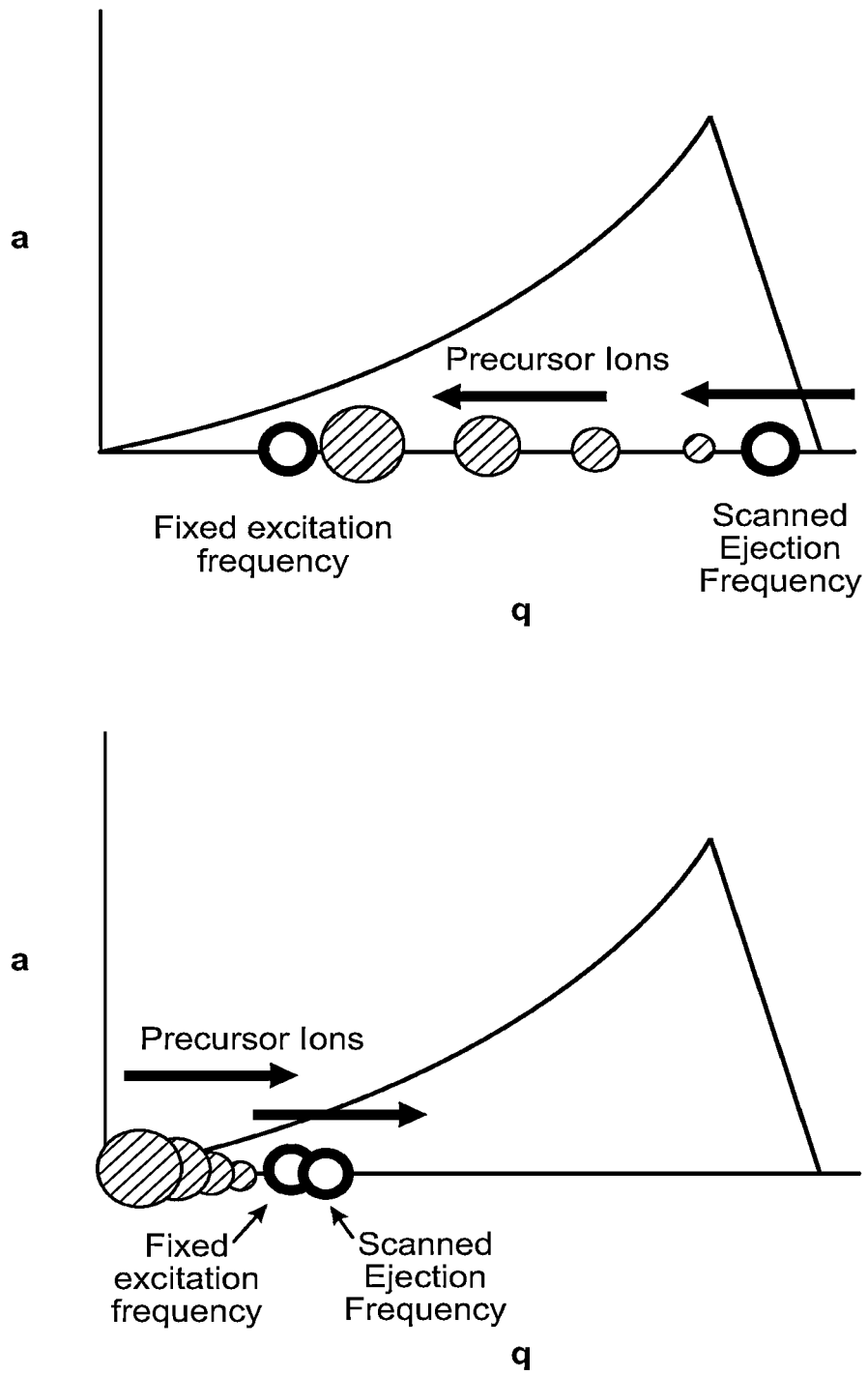
FIG. 1A illustrates a precursor scan in a quadrupole ion trap on the Mathieu stability diagram for both the forward and reverse RF ramp directions.

Commercial ion trap mass spectrometers are based on mass-selective instability scans [Stafford, G. C.; Kelley, P. E.; Syka, J. E. P.; Reynolds, W. E.; Todd, J. F. J. Int. J. of Mass Spectrom. Ion Proc. 1984, 60, 85.]. In the mass-selective instability method, ions of a range of different mass/charge ratios (m/z) are trapped in a quadrupolar field (in either two or three directions, 2D or 3D) through application of a radio frequency (RF) signal of relatively high amplitude (ca. 5 kV) and frequency (ca. 1 MHz). Ions of particular m/z values can be made unstable and hence detectable by an external ion detector by increasing the RF amplitude so that they acquire unstable trajectories and leave the ion trap. By scanning the RF amplitude ($V_{RF}$) to higher values, ions of increasing mass become unstable and a mass spectrum displaying the abundances of ejected ions in order of their m/z values can be recorded. Alternatively, the frequency ($\Omega_{RF}$) of the applied RF can be scanned to cause mass-selective instability to allow a mass spectrum to be recorded [Ding L.; Sudakov M.; Brancia F. L.; Giles R.; Kumashiro S.; J. Mass Spectrom. 2004, 39, 471; Landais, B.; Beaugrand, C.; Capron-Dukan, L.; Sablier, M.; Simonneau, G.; Rolando, C. Rapid Commun. Mass Spectrom. 1998, 12, 302. Kaiser, R. E.; Cooks, R. G.; Stafford, G. C.; Syka, J. E. P.; Hemberger, P. H. Int. J. Mass Spectrom. Ion Proc. 1991, 106, 79. Nie, Z.; Cui, F.; Chu, M.; Chen, C.-H.; Chang, H.-C.; Cai, Y. Int. J. of Mass Spectrom. 2008, 270, 8.]. These scans are all based on the interrelationship between ion stability, expressed in terms of Mathieu parameters a and q, and m/z, $V_{RF}$, $\Omega_{RF}$, the applied DC potential U, and the internal dimensions of the device ($r_0$ and $z_0$, or $x_0$, $y_0$ and $z_0$). In the usual mode of operation, performed without application of a DC potential (U=0), the mass analysis equation is defined by Equation 1 below.

$$m/z=8\ V_{RF}/[0.908(r_0^2+2z_0^2)\Omega_{RF}^2] \quad \text{Equation 1}$$

In standard practice, ions are not ejected by crossing the boundary of the stability diagram as Equation 1 implies. Instead, an additional supplementary alternating current (AC; "supplementary AC") signal is applied so as to set up an approximately dipolar field, usually in the axial direction in a cylindrical ion trap and in the x or y direction in a linear (or rectilinear) ion trap. If the frequency of this AC signal matches a resonance frequency of ions of a given m/z value, then those ions will acquire energy, and if the time of application and the amplitude of the AC signal are appropriate, the ions will leave the ion trap. In order to record a mass spectrum, $V_{RF}$ is scanned while the AC signal is applied at a set frequency. That brings ions of successive mass/charge ratios into resonance with this AC signal and causes their ejection.

In an alternative mode of operation, shown in the case of the halo trap [Austin, D. E.; Wang, M.; Tolley, S. E.; Maas, J. D.; Hawkins, A. R.; Rockwood, A. L.; Tolley, H. D.; Lee, E. D.; Lee, M. L. Anal. Chem. 2007, 79, 2927] and also in conventional cylindrical, rectilinear and miniature ion traps [Snyder, D. T.; Pulliam, C. J.; Wiley, J. S.; Duncan, J.; Cooks, R. G. "Experimental Characterization of Secular Frequency Scanning in an Ion Trap", *J. Am. Soc. Mass Spectrom*. DOI: 10.1007/s13361-016-1377-1], a scan of the AC frequency at constant $V_{RF}$ has been used to record mass spectra. This AC scan experiment is used to resonantly couple energy from the AC signal into the secular motion of the trapped ions and so to cause their excitation and/or ejection.

An ion's secular frequencies, $\omega_{u,n}$, is a set of induced frequencies dependent upon trap parameters and the m/z of the ion [Alfred, R. L.; Londry, F. A.; March, R. E. Int. J. Mass Spectrom. Ion Proc. 1993, 125, 171. Moxom, J.; Reilly, P. T.; Whitten, W. B.; Ramsey, J. M. Rapid Commun. Mass Spectrom. 2002, 16, 755. Fulford, J. E. Journal of Vacuum Science and Technology 1980, 17, 829. March, R. E. J. Mass Spectrom. 1997, 32, 351.], and can mathematically be described by $$\omega_{u,n}=(n+\beta/2)\Omega_{RF}\ 0\leq n\leq\infty \quad \text{Equation 2}$$

and $$\omega_{u,n}=(n+\beta/2)\Omega_{RF}\ -\infty<n<0 \quad \text{Equation 3}$$

where n is an integer and a new parameter β has been introduced. Higher order resonances are predicted to occur when $$\omega_{u,n}=(n+\beta)\Omega_{RF}/K\ -\infty<n<\infty,\ K=1,2,\ldots \quad \text{Equation 4}$$

where K is the order of the resonance [Collings, B. A.; Douglas, D. J. J. Am. Soc. Mass Spectrom. 2000, 11, 1016. Collings, B. A.; Sudakov, M.; Londry, F. A. J. Am. Soc. Mass Spectrom. 2002, 13, 577.]. When n=0 in equation 2, we have the ion's fundamental secular frequency:

$$\omega_{u,0}=\beta\Omega_{RF}/2 \quad \text{Equation 5}$$

For small a (a<0.2) and q (q<0.4), $$\beta=(a+q^2/2)^{1/2} \quad \text{Equation 6}$$

Note that the full definition of P can be found in [March, R. E. J. Mass Spectrom. 1997, 32, 351]. If no DC potential is applied (U=a=0), then we have $$\beta=(2^{1/2}q/2)=2^{3/2}zV_{RF}/\Omega_{RF}^2 r_0^2 m \quad \text{Equation 7}$$

so that $$\omega_{u,0}=2^{3/2}zV_{RF}/2\Omega_{RF}r_0^2 m \quad \text{Equation 8}$$

The constant ($2^{3/2}/2$) in Equation 8 depends on the geometry of the device, but it is nevertheless seen that ions' secular frequencies, under certain conditions, are inversely proportional to m/z. It is also noted that under these same conditions of low values of a and q Mathieu parameters, ion motion is almost sinusoidal and the contributions from higher order resonances are negligible unless the percentage of the quadrupole field in the ion trap is unusually small.

Aspects of the invention describe an arrangement to extend the MS/MS capabilities of quadrupole ion traps to encompass the full range of experiments, as is achieved using a tandem mass spectrometer (viz. a triple quadrupole, a hybrid quadrupole mass filter/time of flight instrument, or a tandem magnetic sector instrument). That is, the invention generally relates to systems and methods for precursor and neutral loss scans in a single ion trap. In certain embodiments, the invention provides systems that include a mass spectrometer having an ion trap, and a central processing unit (CPU). The CPU includes storage coupled to the CPU for storing instructions that when executed by the CPU cause the system to excite a precursor ion, optionally as a function of time, and eject a product ion in the single ion trap. In certain embodiments, both excitation of the precursor ion and ejection of the product ion occur simultaneously. Numerous approaches may be used to accomplish aspects of the invention, as will be described herein. In one embodiment, both excitation of the precursor ion and ejection of the product ion are accomplished through application of two signals to the single ion trap. For example, a first signal is a constant alternating current (AC) signal, and a second signal is a radio frequency (RF) signal, which optionally varies as a function of time. The radio frequency (RF) signal may be varied in a forward direction (increasing with time) or a reverse direction (decreasing with time). Ejection of the product ion then occurs through simultaneous application of a third signal to the ion trap. In other embodiments, a first signal is a constant radio frequency (RF), and a second signal is a first alternating current (AC) signal that varies as a function of time. In certain embodiments, the frequency of the first AC signal varies as a function of time. In other embodiments, an amplitude of the first AC signal varies as a function of time. Typically, the first AC signal is in resonance with a secular frequency of ions trapped within the ion trap. In certain embodiments, the first AC signal is in resonance with a secular frequency of ions of more than one mass/charge ratio trapped within the ion trap.

Constant AC Signal with an RF Signal that Varies as a Function of Time

In certain embodiments, precursor ions are fragmented at an optimal q value by setting the excitation frequency and forcing a low amplitude. Ions are fragmented as a function of time by scanning the RF amplitude in either the forward or reverse direction. A second resonance frequency corresponding to the product m/z of interest is simultaneously applied to the trap in a dipolar manner (as is the excitation). This frequency is scanned (i.e. a secular frequency scan) since the product ion's m/z changes as a function of time due to the RF amplitude ramp. Thus, a precursor scan can be performed in a single ion trap. A neutral loss scan can also be performed by instead scanning the frequency of the product ejection waveform at a constant mass offset from the precursor ions (compared to scanning at a constant mass for the precursor scan).

Figure 1B:
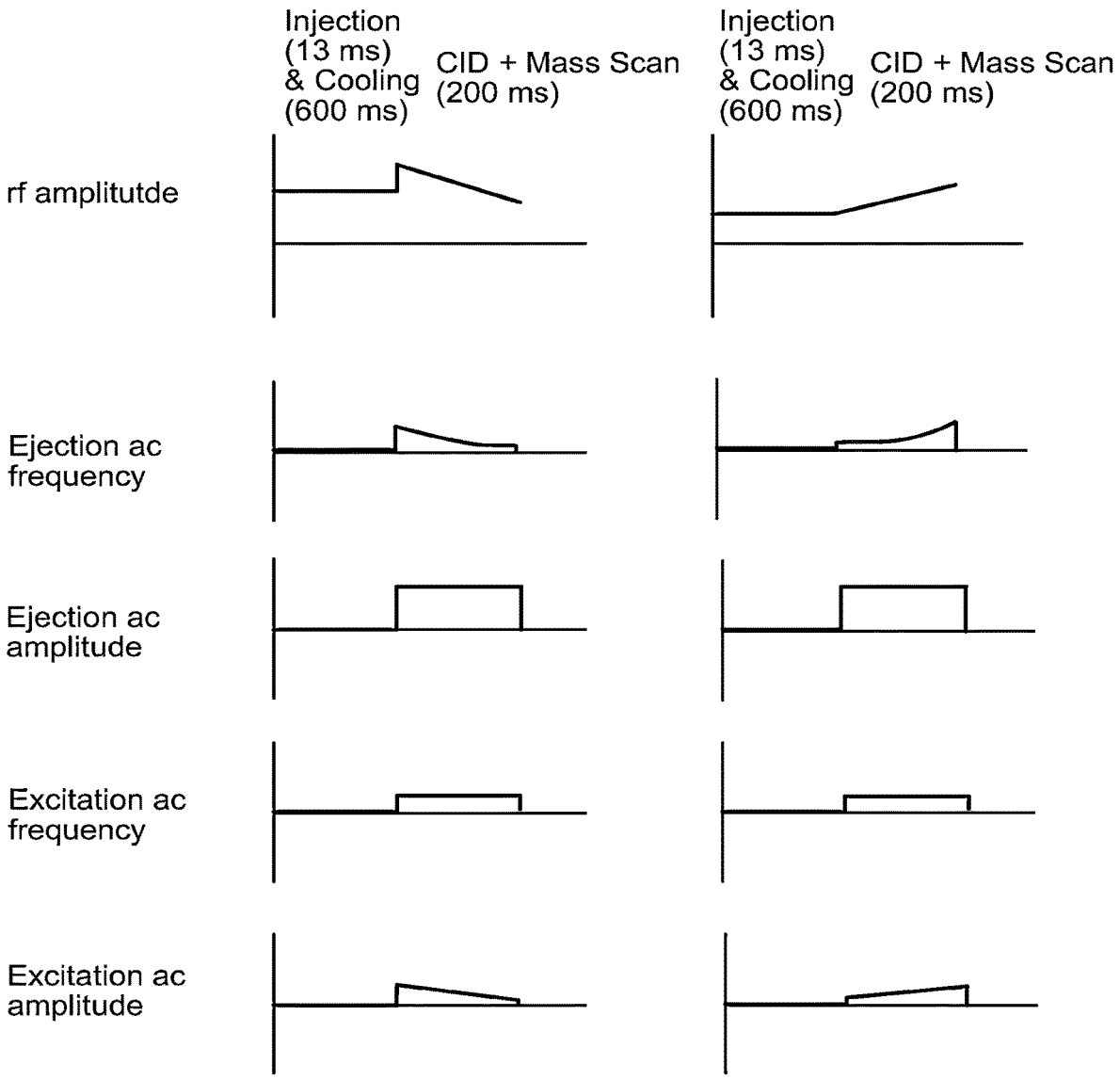
FIG. 1B shows the waveforms used for the precursor scan using either a forward or reverse RF amplitude ramp.

FIG. 1A illustrates a precursor scan in a quadrupole ion trap on the Mathieu stability diagram for both the forward and reverse RF ramp directions. FIG. 1B shows the waveforms used for the precursor scan using either a forward or reverse RF amplitude ramp.

Figure 2:
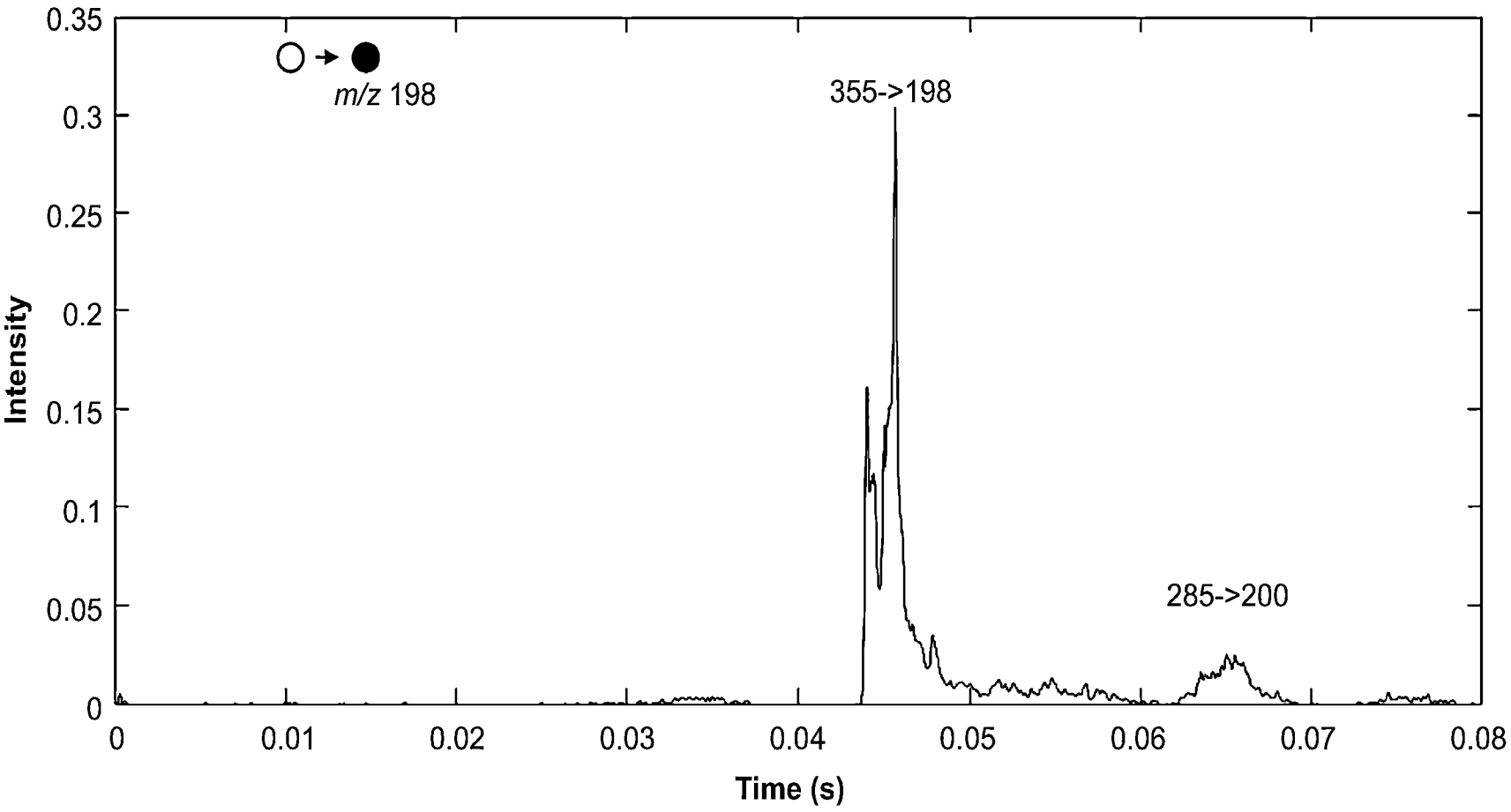
FIG. 2 shows a reverse precursor scan of product ion m/z 198 from a mixture of five tetraalkylammonium ions (tetrabutylammonium (m/z 242), hexadecyltrimethylammonium (m/z 284), tetrahexylammonium (m/z 355), tetraoctylammonium (m/z 467), and tetraheptylammonium (m/z 411)).

FIG. 2 shows a reverse precursor scan of product ion m/z 198 from a mixture of five tetraalkylammonium ions (tetrabutylammonium (m/z 242), hexadecyltrimethylammonium (m/z 284), tetrahexylammonium (m/z 355), tetraoctylammonium (m/z 467), and tetraheptylammonium (m/z 411)). As shown, only two ions, m/z 355 and m/z 285 are detected since only these two precursors have product ions near m/z 198. The secular frequencies of m/z 198 and m/z 200 were close enough so that both ions were ejected from the trap. The spectrum was collected on the Mini 12 miniature mass spectrometer.

Figure 3:
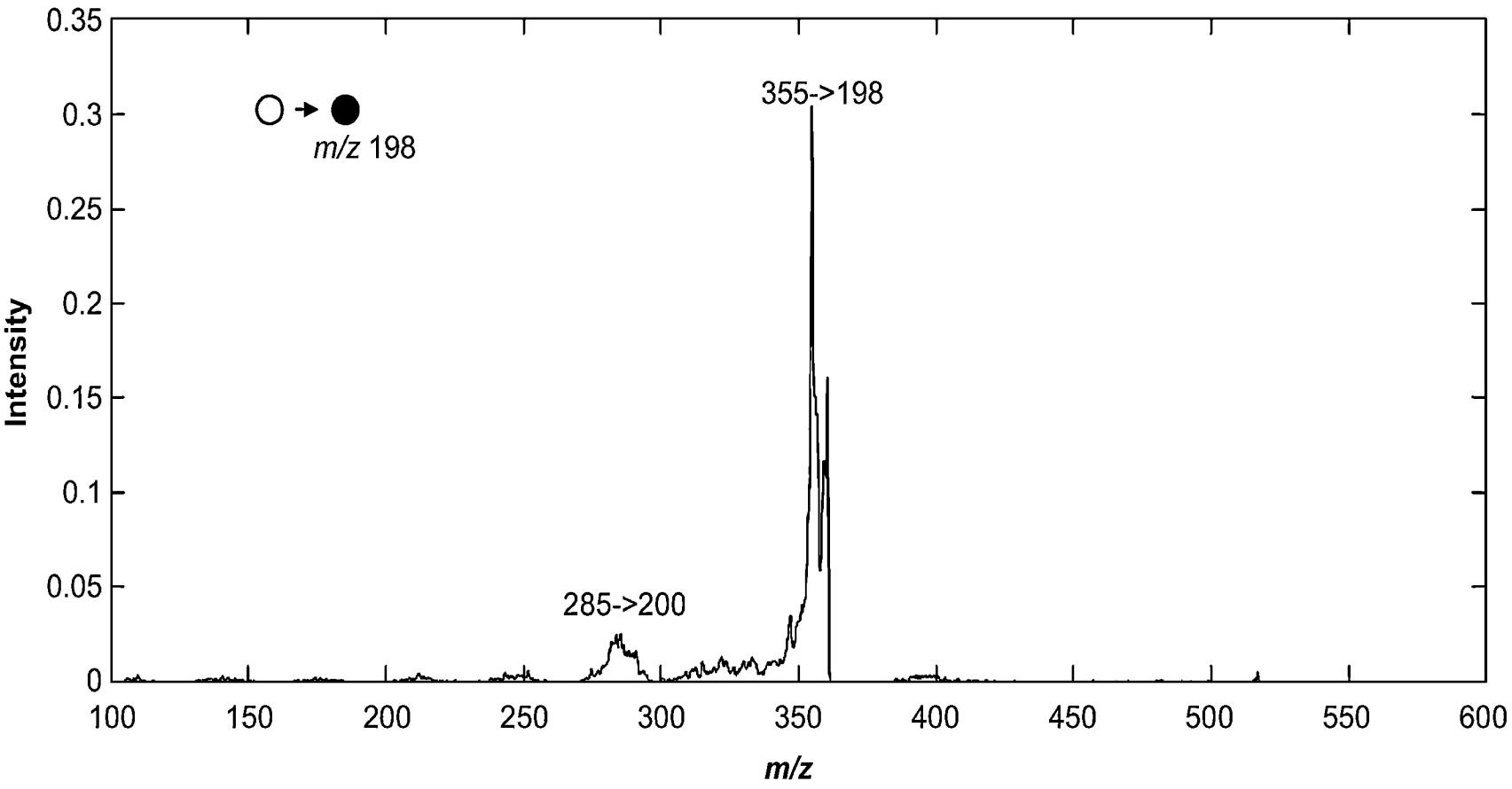
FIG. 3 shows the mass calibration for the spectrum in FIG. 2.

FIG. 3 shows the mass calibration for the spectrum in FIG. 2. The two peaks are unambiguously m/z 285 and m/z 355. It should be noted that the detected ions were m/z 200 and m/z 198, but the peaks correspond to fragmentation of the parent ions, m/z 285 and m/z 355.

Figure 4:
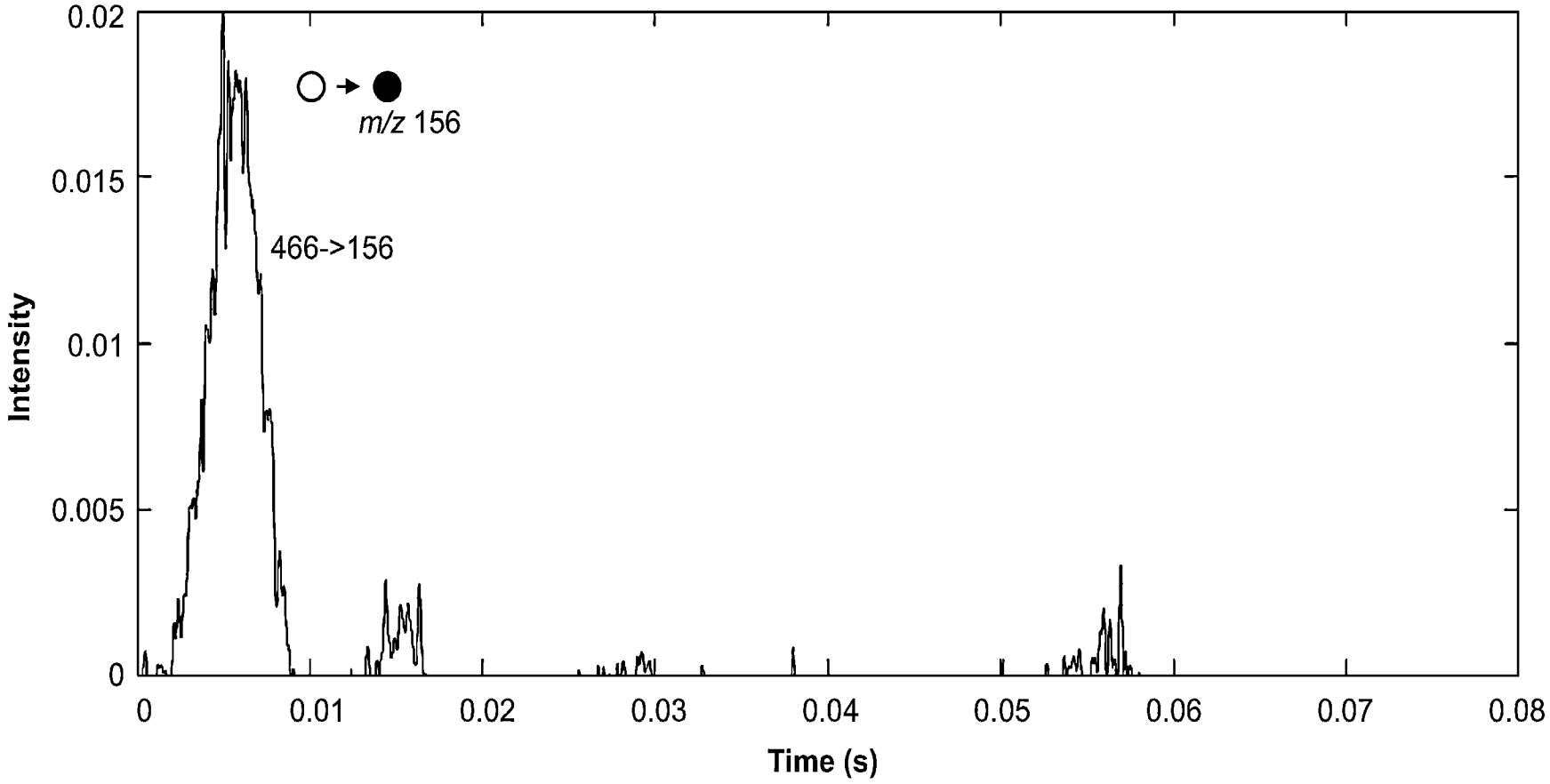
FIG. 4 shows the time domain reverse precursor scan mass spectrum of m/z 156.

FIG. 4 shows the time domain reverse precursor scan mass spectrum of m/z 156. Only m/z 466 fragments to m/z 156, thus giving a single peak in the spectrum.

Figure 5:
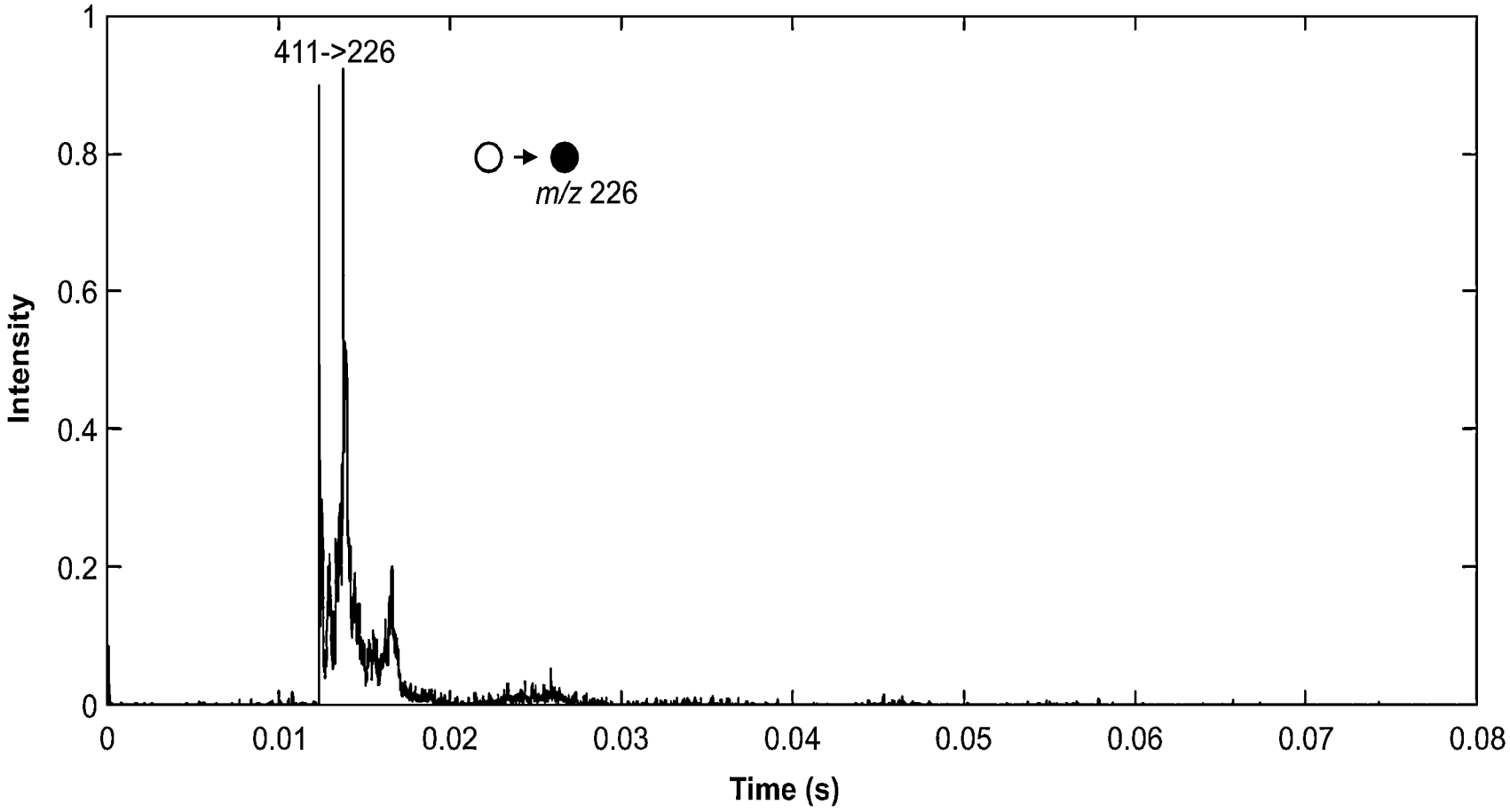
FIG. 5 shows the time domain reverse precursor scan mass spectrum of m/z 226.

FIG. 5 shows the time domain reverse precursor scan mass spectrum of m/z 226. Only m/z 411 fragments to m/z 226, thus giving a single peak in the spectrum.

FIG. 6 is a table showing the MS/MS space of five tetraalkylammonium ions (tetrabutylammonium (m/z 242), hexadecyltrimethylammonium (m/z 284), tetrahexylammonium (m/z 355), tetraoctylammonium (m/z 467), and tetraheptylammonium (m/z 411)). These can be compared with the precursor scan results.

Figure 7:
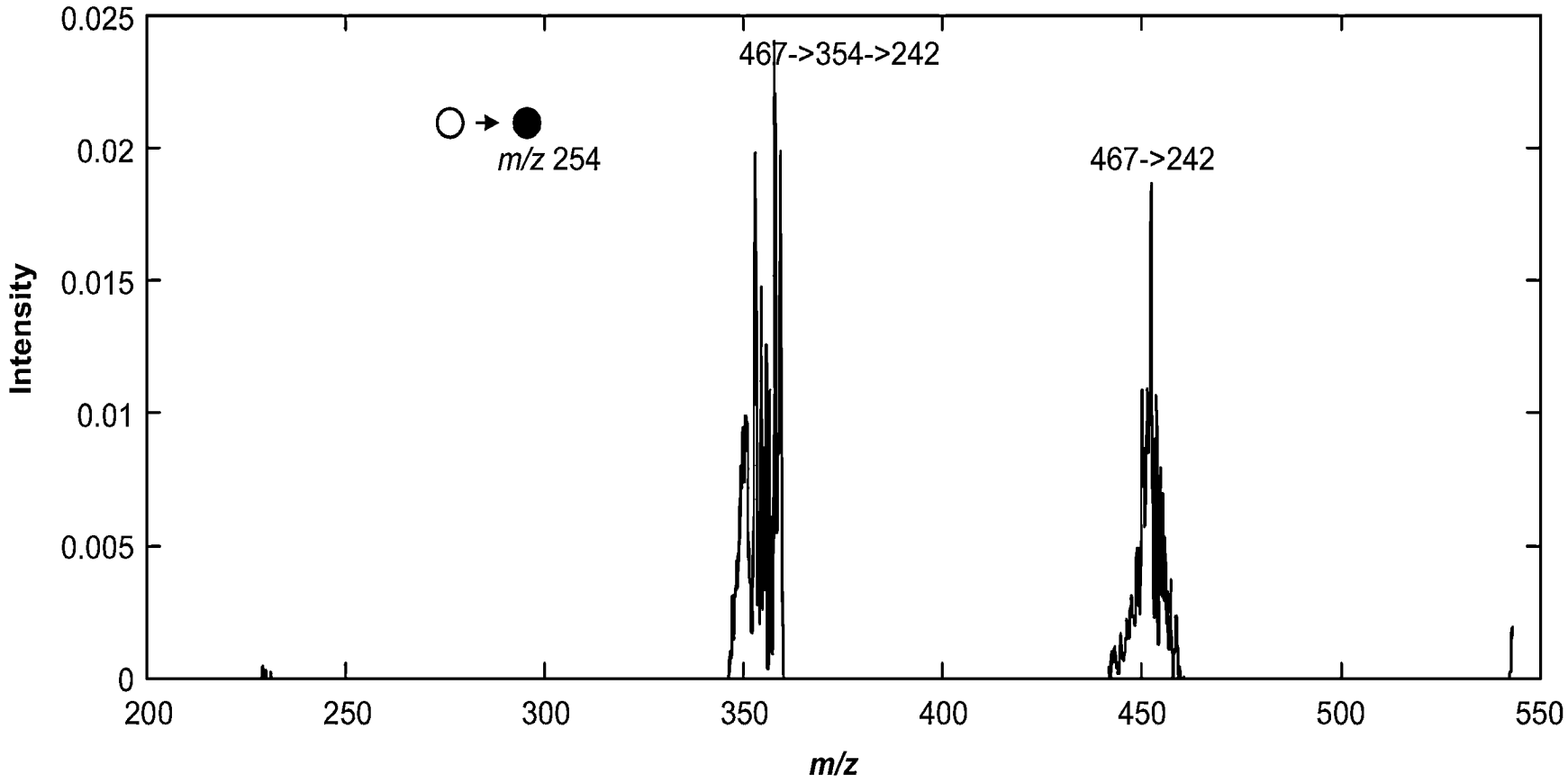
FIG. 7 is a figure that illustrates the choice of scan direction on the precursor scan mass spectrum.
Figure 8A:
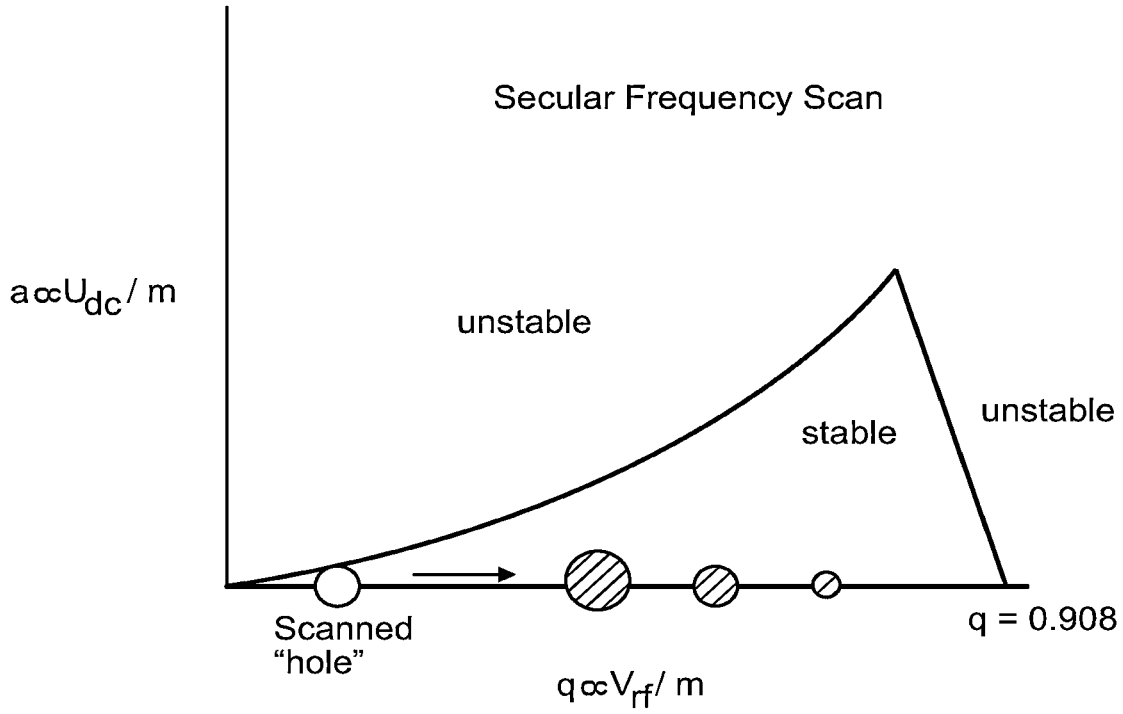
FIGS. 8A-D conceptually illustrate secular frequency, precursor, neutral loss, and multiple reaction monitoring scans on the Mathieu stability diagram using a constant RF amplitude. In a secular frequency scan, application of a supplementary AC waveform creates a "hole" on the q axis of the stability diagram. As the hole is scanned throughout the mass range, ions are ejected in order of increasing or decreasing m/z, depending on scan direction. In a precursor scan, ions are mass selectively excited by one variable frequency waveform, while another AC waveform is set at a fixed frequency corresponding to a particular product ion. In a neutral loss scan, both waveforms' frequencies are swept (at different rates) so that there is a constant mass offset between them. Lastly, in multiple reaction monitoring (or selected reaction monitoring) two or more fixed frequency signals corresponding to precursor and product ions are applied to the mass analyzer to excite the precursor(s) and eject the product(s). Solid blue dots indicate ions of different m/z values.
Figure 8B:
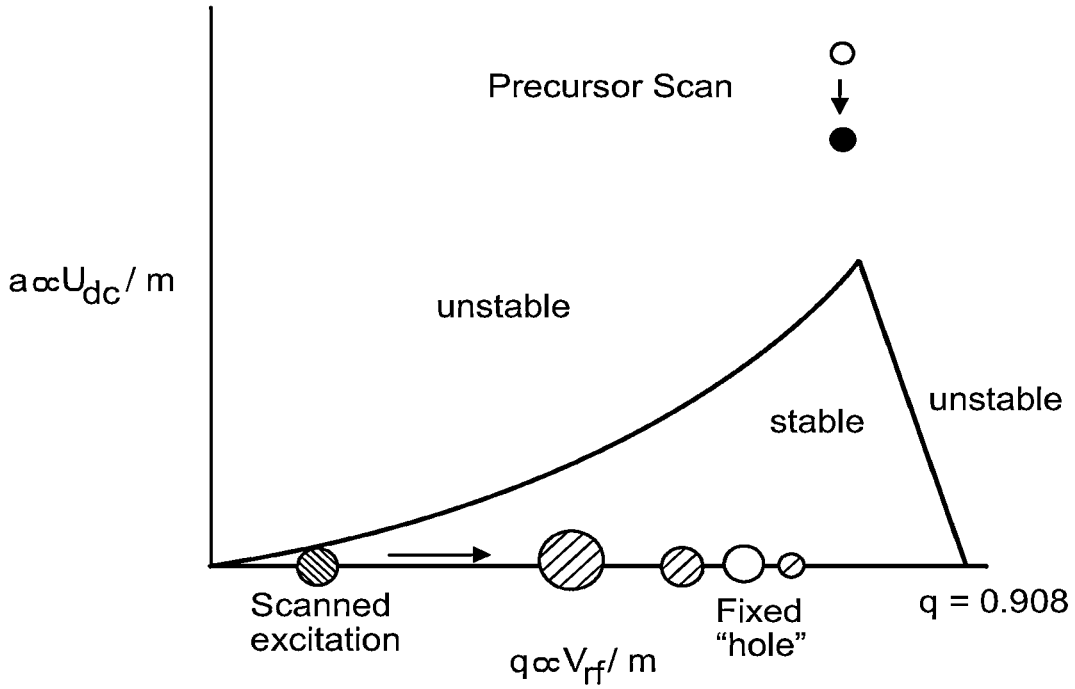
Figure 8C:
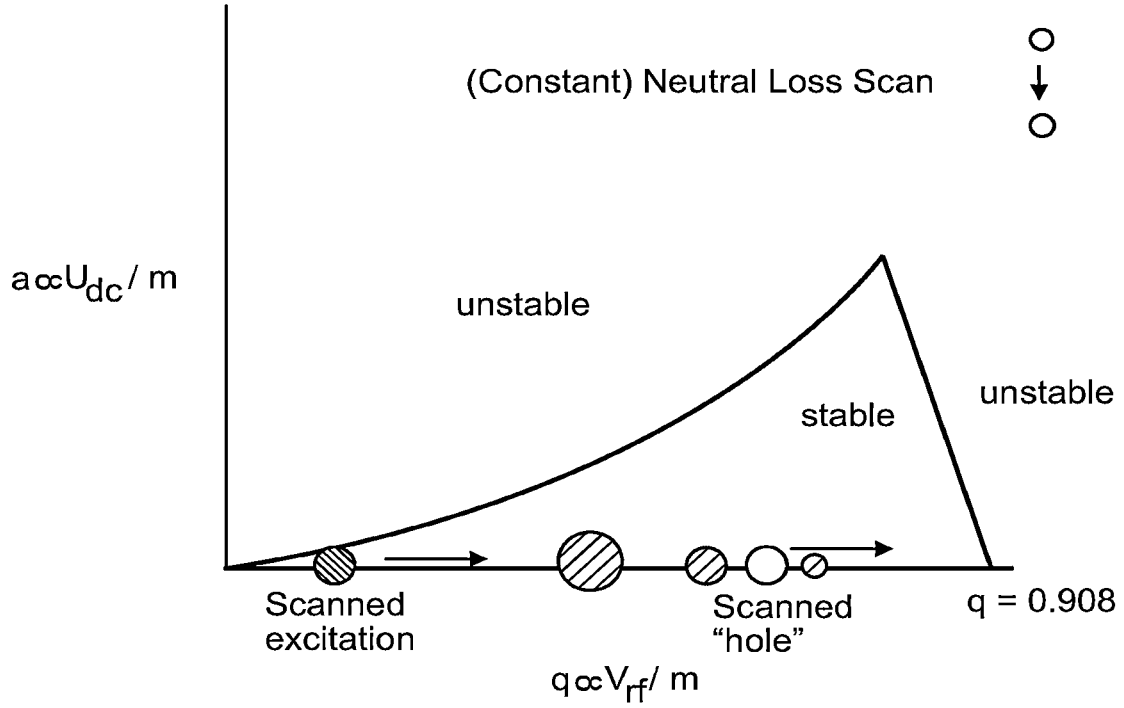
Figure 8D:
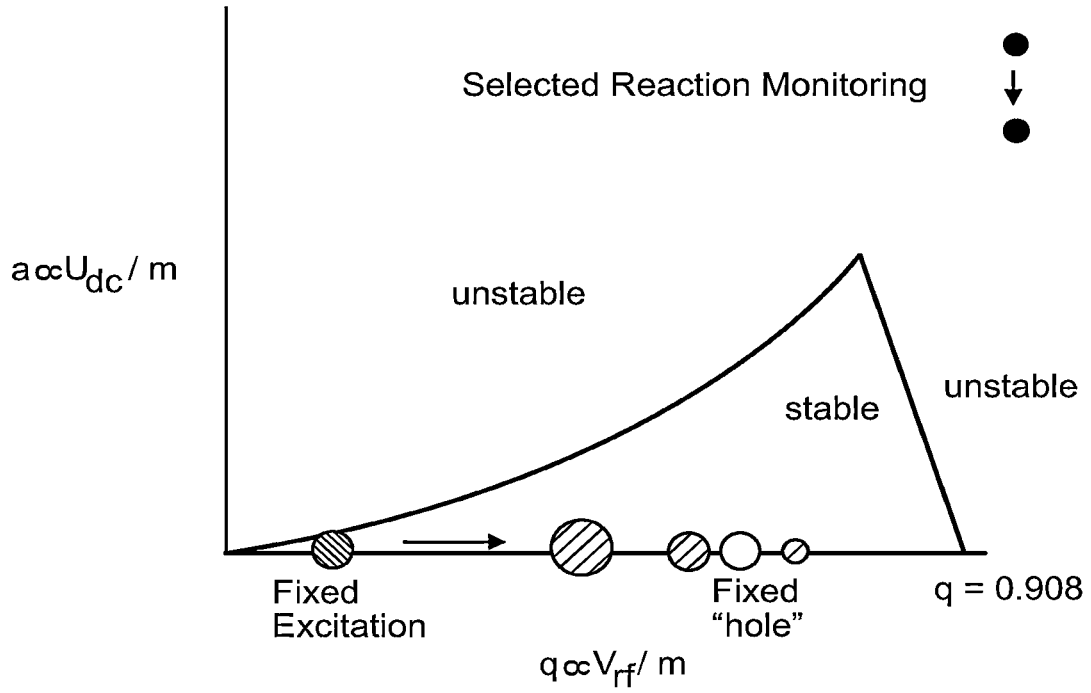

FIG. 7 is a figure that illustrates the choice of scan direction on the precursor scan mass spectrum. If a reverse precursor scan is performed (i.e. if the RF amplitude is ramped from high to low), then multiple stages of fragmentation are observed, and thus a multidimensional precursor scanned (as could be done on a pentaquadrupole mass spectrometer) is performed. In this example, a reverse precursor scan of m/z 254 was performed, giving two peaks. m/z 467 is the only precursor ion that gives a fragment at m/z 242, but a second peak is observed due to two-stage fragmentation of m/z 467 to m/z 354 and then subsequently to m/z 242.

Variants in which three stages of mass analysis (and two stages of dissociation or other ionic process which results in mass or charge changes) can be envisioned as simple extensions of the above ideas. For example, an interesting aspect of exciting the precursor ion when the RF amplitude is ramped in the reverse direction is that fragmentation occurs from high to low mass and thus multiple stages of fragmentation are observed. Accordingly, the invention allows in certain embodiments for performance of a >2-dimensional precursor scan ($MS^2$, $MS^3$, $MS^4$, and so on, as can be performed in a pentaquadrupole mass spectrometer).

In certain embodiments, as applied to the ion trap, the frequency ($\omega_{ac}$) of a supplementary AC signal is kept constant, while $V_{RF}$ and $\Omega_{RF}$ are constantly scanned in either the forward or reverse direction. By keeping the AC signal constant and scanning the radiofrequency parameters, $V_{RF}$ and $\Omega_{RF}$ in either the forward or reverse direction, the systems of the invention advantageously brings ion trap capabilities closer to that of the widely used triple quadrupole. In certain embodiments, that AC signal may include two supplementary AC signals applied orthogonally (e.g. AC1 in x and AC2 in y).

Constant RF Signal with an AC Signal that Varies as a Function of Time

In another embodiment, a mass spectrum can be recorded by scanning the frequency of a low amplitude AC signal applied so as to establish an approximately dipolar field in a 2D or 3D quadrupole ion trap of linear, rectilinear, cylindrical or other geometry. The AC signal is applied so as to eject trapped ions through resonance with their secular (or related) frequency for collection at an external detector. The ejection is performed while the ions are trapped in the (approximately) quadrupolar field established by applying the main trapping RF to the electrode structure. Neither the amplitude nor the frequency of the main RF need be scanned to record a mass spectrum. The data herein can be extended to cover operation of a quadrupole mass filter operated at low mass resolution (broad bandpass mode) so as to mass-selectively eject ions by scanning the frequency of a supplementary AC signal applied to establish a dipolar field orthogonal to the direction of ion motion through the mass filter. In certain embodiments, that AC signal may include two supplementary AC signals applied orthogonally (e.g. AC1 in x and AC2 in y).

Scanning the frequency of a supplementary AC signal used to superimpose a small dipole field on a main trapping quadrupolar field allows a mass/charge spectrum to be recorded. The simplification in the electronics achieved by frequency scanning a low amplitude signal is particularly useful to small, miniature mass spectrometer systems. The supplementary signal can be in resonance with the secular frequency of the trapped ions or with a related frequency. The relaxation of the dimensional tolerances of the electrode structures that is possible in this mode of operation compared to conventional quadrupole mass filters is a further advantage for small, miniature systems. The ion trap can be hyperbolic, cylindrical, linear, or rectilinear ion trap with either 2D or 3D trapping fields, or it can be a 2D mass filter.

The trapped ion population from which ions are resonantly ejected can cover a wide range of m/z values (from the low mass cut-off value in the ion trap to essentially unlimited high values) or it can be a much narrower range, chosen by the $V_{RF}/U$ ratio in the mass filter case. The applied AC frequency can be single-valued or a range of frequencies can be used, for example those created in a SWIFT (stored waveform inverse Fourier transform) experiment.

In certain embodiments, that AC signal may include two supplementary AC signals applied orthogonally (e.g. AC1 in x and AC2 in y). By control of the AC amplitude, the ion trap can be operated to first activate a selected ion or population of ions, and then, using the frequency scan, to interrogate the products of the activation process, that is, to perform product ion MS/MS scans. In one embodiment, the mass filter experiment can be done using orthogonal detectors so that the ejected ions are detected on a detector that is orthogonal to an in-line detector. One detector measures the ejected ions and the other measures all stable ions. This allows the measurement of precursor ion MS/MS spectra in a mass filter or linear ion trap. This is done by continuously observing the signal intensity of the selected product ion by AC resonant ejection into a detector while scanning the frequency of a second AC signal applied orthogonally to the direction first. The orthogonal application of the second dipolar field is a convenience that allows activation to be in a direction in which the potential well is deeper, as in an ion trap with r-direction rather than z-direction activation or in a mass filter where the x- and y-directions are deliberately asymmetrical.

Figure 9:
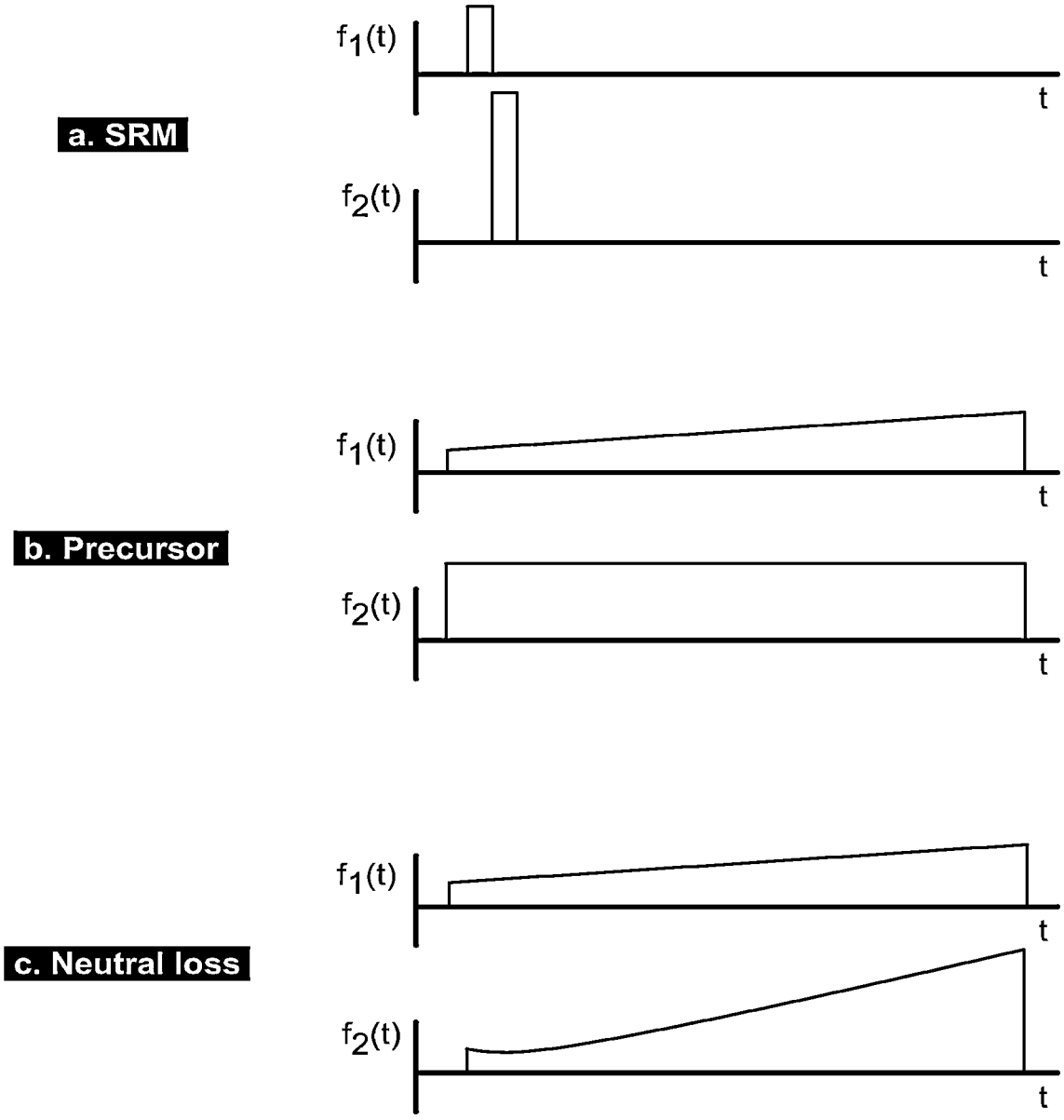
FIG. 9 panels A-C conceptually illustrate the selected reaction monitoring scan (FIG. 9 panel A), precursor ion scan (FIG. 9 panel B), and neutral loss scan with frequency versus time for the two necessary AC waveforms (FIG. 9 panel C) applied with a constant RF amplitude.

Accordingly, this embodiment provides another arrangement to extend the MS/MS capabilities of quadrupole ion traps to encompass the full range of experiments, as is achieved using a tandem mass spectrometer (viz. a triple quadrupole, a hybrid quadrupole mass filter/time of flight instrument, or a tandem magnetic sector instrument). Aspects of this embodiment are accomplished by providing two single frequency AC signals where either frequency can be held constant or scanned over a range of frequencies. Consider the case where one AC signal is set to the secular frequency of a chosen product (fragment) ion while the second AC signal is set to correspond to the frequency of the precursor ion. If the amplitude of the signals are adjusted so that the precursor ion is excited but not ejected from the trap while the product ion frequency has an amplitude appropriate for ion ejection, the result will be a single reaction monitoring (SRM) experiment, i.e. the signal for reaction $m_1^+ \rightarrow m_2^+ + m_3$ will be observed. A second experiment, the precursor ion scan MS/MS experiment, can be performed if the frequency of one of the single frequency AC signals is scanned while the other is held constant at the secular frequency of a selected product ion, $m_2^+$. All precursor ions, $m_1^+$, which give a particular $m_2^+$ will appear in this spectrum. In this embodiment, the scanned signal has a low amplitude for precursor fragmentation, whereas the constant frequency signal has a higher amplitude for product ejection. In a third experiment, both AC frequencies are swept but in such a way that the corresponding masses of the precursor and product are incremented in a fixed relationship, specifically so that there is a constant mass difference between them. This gives a constant neutral loss spectrum, which is yet another type of MS/MS spectrum not otherwise accessible using a single mass analyzer. FIGS. 8A-D illustrate the Mathieu stability diagrams, and shows conceptually how these scans may be implemented. FIG. 9 panels A-C show the two AC frequencies used for each experiment. Note that the frequencies can be applied separately or combined into a single signal (e.g. via a summing amplifier). Note also that the timing of application of the AC frequencies is a variable which can be optimized by simulation or experiment.

The concepts just noted also can be implemented by applying, simultaneously, a single waveform which contains the features of interest, i.e. (i) for an SRM signal, the sum of two fixed frequencies, (ii) for a precursor scan, the sum of a swept frequency and a fixed frequency and (iii) for a neutral loss scan, the sum of two swept frequencies. A variant in which neither frequency is swept but different frequencies are applied corresponding to the secular frequencies of the precursor and product ions will give selected reaction monitoring (SRM) data. A variant in which more than one precursor/product pair is examined iteratively corresponds to the MRM experiment [Kondrat, R. W.; McClusky, G. A.; Cooks, R. G. Anal. Chem., 1978, 50, 2017] commonly used in quantitative proteomics and other quantitative analysis experiments [Picotti, P.; Aebersold, R. Nature Methods, 2012, 9, 555-566]. Variants in which three stages of mass analysis (and two stages of dissociation or other ionic process which results in mass or charge changes) are used can be envisioned as simple extensions of the above ideas.

Figure 11A:
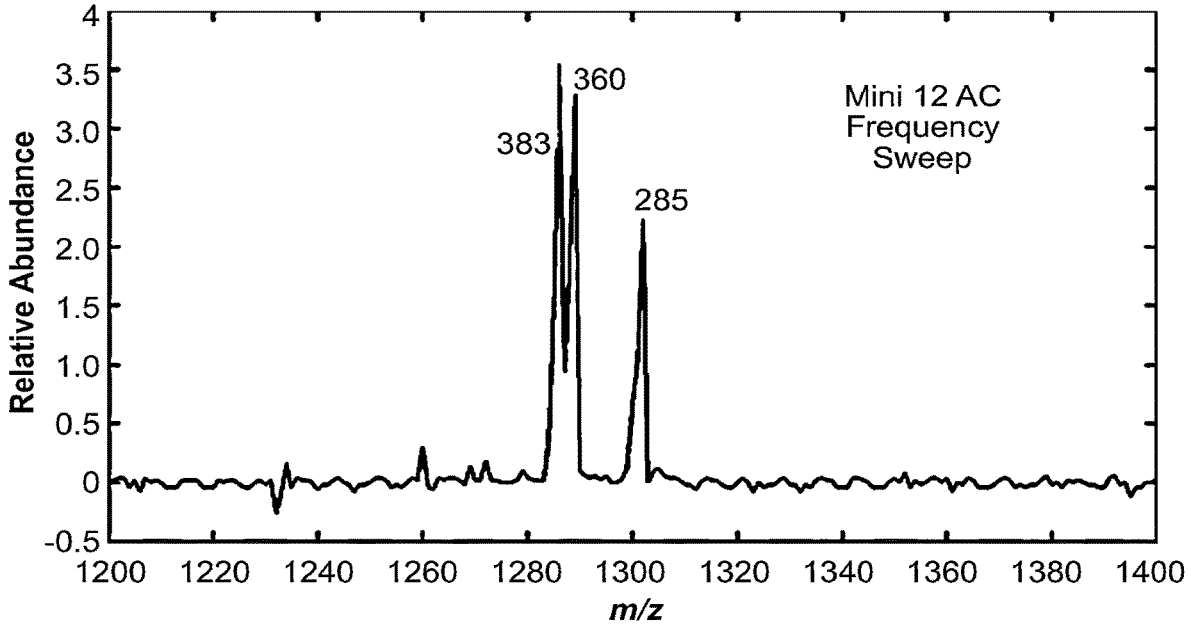
FIGS. 11A-D show AC frequency scan mass spectra of tetraalkylammonium salts (cations m/z 285, 360, 383) recorded
Figure 11B:
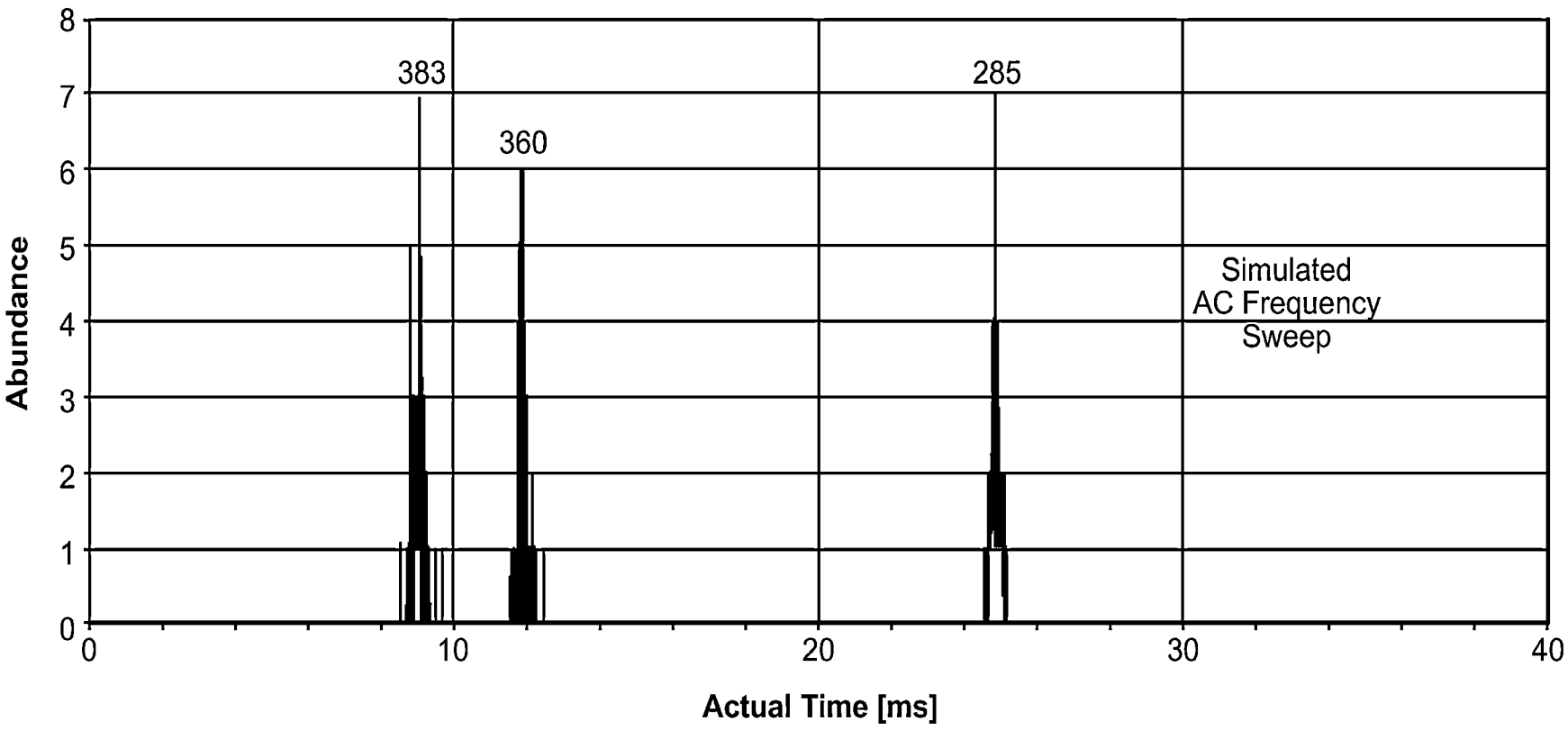
Figure 11C:
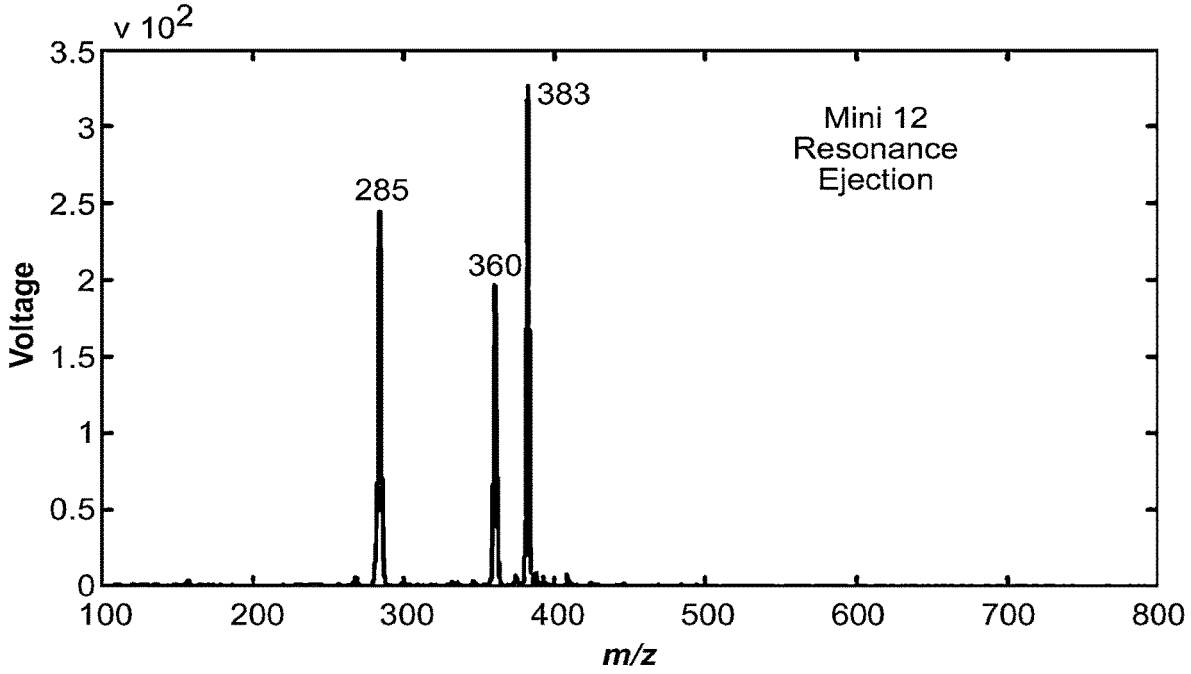

In certain embodiments, as applied to the ion trap, the frequency ($\omega_{ac}$) of a supplementary AC signal is scanned, while $V_{RF}$ and $\Omega_{RF}$ are kept constant. The amplitude of the AC signal may be scanned too but that is not required. The scan of $\omega_{ac}$ produces a mass spectrum, as seen in FIGS. 11A and 12C. An advantage of such a scan over conventional scanning methods is that the high voltage and high frequency parameters, $V_{RF}$ and $\Omega_{RF}$, can be kept constant, greatly simplifying the electronics requirements that are involved in scanning one or other of these parameters in a highly precise way over time. In ion traps of conventional size, $V_{ac}$ is just a few volts and the frequency $\omega_{ac}$, is in the kHz range. These parameters, especially the low voltage plus the ease with which frequencies can be scanned, make this a simple and attractive scan mode. The skilled artisan will know how to select values of $\omega_{ac}$. This capability is used so that ions of particular m/z values (or a window of m/z values, or several ions of different m/z values) can be selected and activated so as to be ejected from the trap (without being mass measured) to allow the remaining ions to be used as precursor ions in product ion MS/MS experiments. Alternatively, the ions of selected m/z values or ranges can be activated without ejection to cause them to undergo collisional fragmentation to generate the product ions that are observed in a subsequent scan of $V_{RF}$ or $\omega_{ac}$ that generates a product ion MS/MS spectrum. The alternative types of MS/MS scan (other than the product ion scan) cannot be implemented using a single frequency AC signal. This can only produce a mass scan or be used for single ion monitoring with $V_{RF}$ scanning over a narrow range. The alternative scans can be produced by adding in more AC signals with fixed or scanned frequencies in order to provide resonance with either the secular frequencies of the parent or product ions or both.

In certain embodiments, the properties of the main trapping field established by the operating parameters $V_{RF}$ and U are selected so as to trap the ions within the ion trap. During that operation, a supplementary AC signal of relatively low amplitude can be applied to cause the ions to become unstable. That instability results in the ions being ejected, orthogonally or axially, from the ion trap in order of ascending or descending m/z ratio. In practice the forward sweep (reverse m/z scan) is far more efficient. The ejected ions impinge on a detector, and a mass spectrum is recorded.

In other embodiments, the properties of the main trapping field established by the operating parameters $V_{RF}$ and U are selected so as to allow a relatively wide range of m/z values of ions to have stable trajectories and drift through the device to an in-line detector. During that operation, a supplementary AC signal of relatively low amplitude can be applied to set up a dipolar field at a frequency which is in resonance with the secular frequency of motion of ions of a particular m/z value. Depending on whether this signal is applied in the x- or the y-direction, the resonant ions will acquire kinetic energy and become unstable (cross the x- or y-stability boundary in the Mathieu stability diagram) and be lost to the electrode structure or ejected into a second orthogonal detector. By scanning the frequency of the supplementary AC signal, ions of different m/z values will be made unstable and a mass spectrum is recorded. Note that a mass spectrum can also be recorded by observing the loss of signal at the in-line detector.

The proposed AC-based MS/MS scan modes are particularly well suited to use in miniature mass spectrometers because simplified less expensive electronics is highly desirable in the cost, weight and power constrained system of a miniature mass spectrometer. In fact, achieving linear scans of $V_{RF}$ is a major contributor to the complexity of the electronics systems of miniature ion traps. See Paul et al. (Anal. Chem., 2014, 86, 2900-2908 DOI: 10.1021/ac403765x) and Li et al. (Anal. Chem. 2014, 86, 2909-2916, DOI: 10.102/ac403766c). It is much easier to set a fixed frequency MHz trapping signal in the kV range and scan a few volt kHz signal than it is to perform the normal mass selective instability scan with a varying $V_{RF}$ or even with a varying $\Omega_{RF}$. That is, scanning the frequency of a 10 v signal is easier than scanning the frequency of a kV signal.

Such a manner of operating a mass spectrometer allows for miniaturization to the point that it possible to fabricate a cell phone mass spectrometer for gas and vapor analysis. Details of miniaturization are provided in Blain et al., (Int. J. Mass Spectrom. 2004, 236, 91-104.), the content of which is incorporated by reference herein in its entirety.

FIGS. 8A-D show the conceptual illustration of secular frequency scanning and single analyzer MS/MS scans on the well-known Mathieu stability diagram, which describes the stability of ions in a quadrupolar field.

Similarly, FIG. 9 panels A-C show frequency versus time for the two waveforms needed in each MS/MS scan (precursor, neutral loss, and selected reaction monitoring). In a secular frequency scan, the frequency of the supplementary AC waveform is varied as a function of time so that ions of increasing (or decreasing) m/z are ejected as a function of time as the AC frequency matches each m/z's unique resonance frequency. In selected reaction monitoring, two AC waveforms are set at (different) fixed frequencies corresponding to a precursor ion and a product ion of that precursor (and different amplitudes) so that the precursor is fragmented and the product ejected. In a precursor scan, a small amplitude AC signal is swept in frequency so that all ions in the device are mass selectively fragmented, while a second AC waveform has a frequency fixed on a particular fragment ion so as to eject that product ion when it is formed in the trap. In a neutral loss scan, two AC waveforms are swept in frequency at different rates such that there is a constant mass offset between them. Ions are only ejected when they experience a neutral loss corresponding to the difference in mass as reflected in the values of the two applied resonant frequencies.

Figure 10:
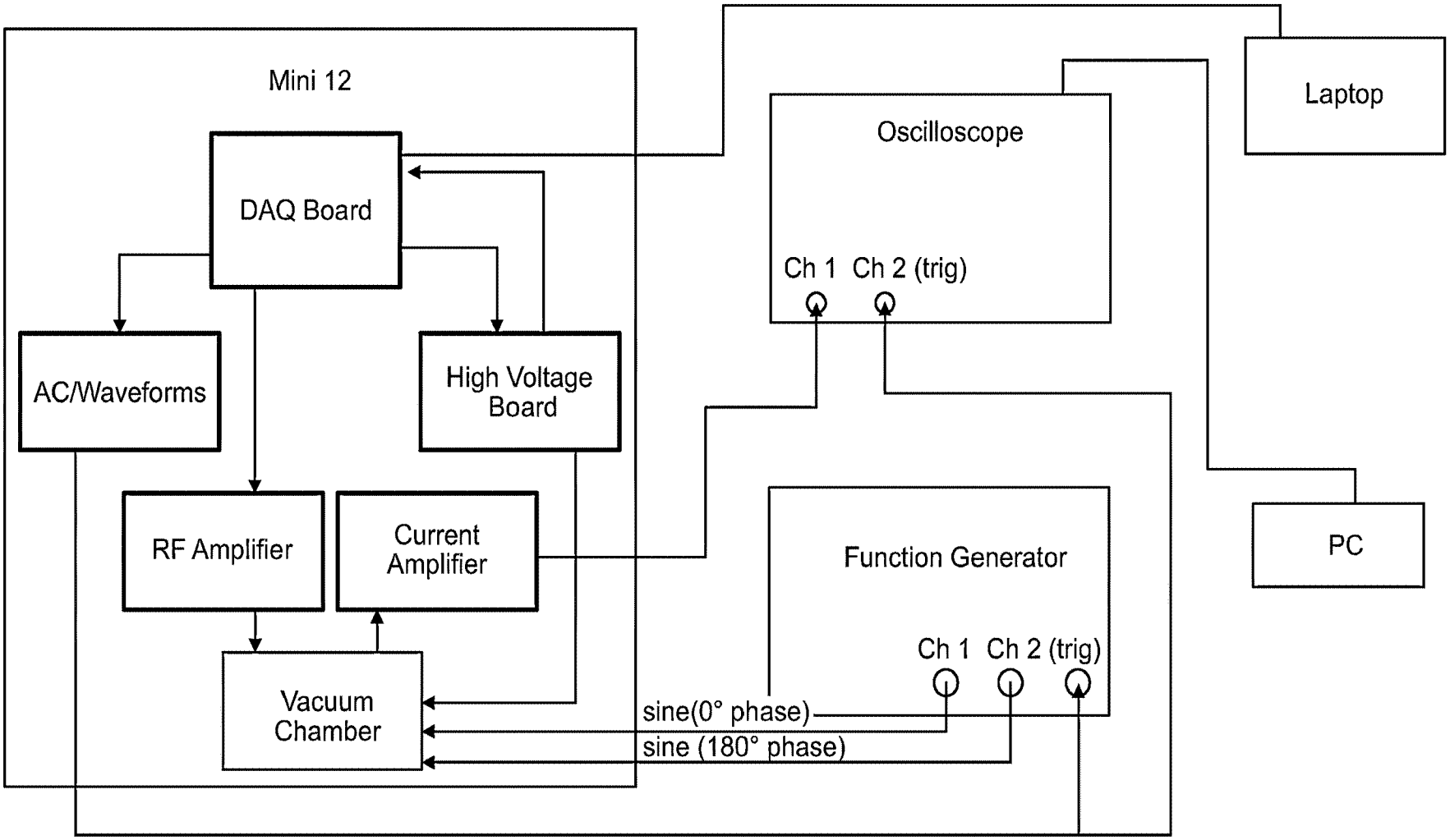
FIG. 10 shows the instrumental arrangement used to implement AC frequency scan mass spectra and precursor scan MS/MS spectra using a miniature mass spectrometer. In precursor scans, the outputs from the AC/waveforms board on the Mini 12 and the function generator are fed into two summing amps (one for each signal polarity), and the output of the summing amps was applied to the x electrodes of the ion trap. In this experiment the two separate secular frequencies (AC frequencies) needed to record MS/MS spectra of the SRM, precursor scan and constant neutral loss types are provided through a single combined signal.

FIG. 10 shows an instrumental arrangement used to apply AC and RF signals to a miniature rectilinear ion trap mass spectrometer operated with a constant RF and with a swept frequency AC signal. Mass spectra are recorded using the AC frequency scan while precursor ion MS/MS spectra require simultaneous application of a fixed frequency AC (to resonantly eject the product ion) and a scanning AC frequency (to resonantly excite the precursors in turn). The outputs from the AC/waveforms board on the Mini 12 and the function generator are fed into two summing amps (one for each signal polarity), and the output of the summing amps are applied to the x electrodes of the ion trap. The ejection of ions by the AC voltage occurs at different values of $q_z$ in the AC scanning operation of the ion trap.

Figure 11D:
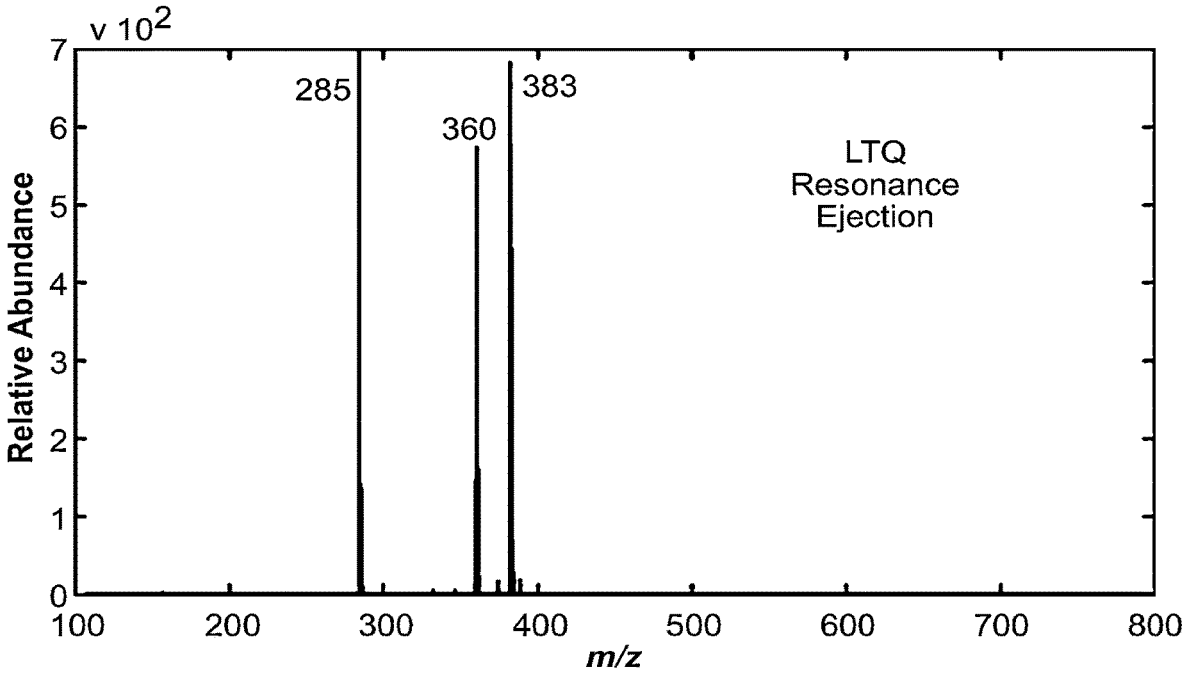

FIGS. 11A-D show spectra of a mixture of tetraalkylammonium salts (cations m/z 285, 360, 383) recorded using a Mini 12 instrument in the AC frequency scan mode. The frequency sweep from low to high frequency ejects high mass ions earlier than low mass ions. Comparison of the experimental data with simulated data (ITSIM 6.0) shows good agreement but with some loss of resolution. The usual RF scan (resonance ejection mode) shown in the 11C of the figure is in good agreement with simulation and has better resolution than the AC Mini 12 spectrum. The commercial LTQ instrument gives data of similar quality to the Mini 12 (FIG. 11D).

Figure 12A:
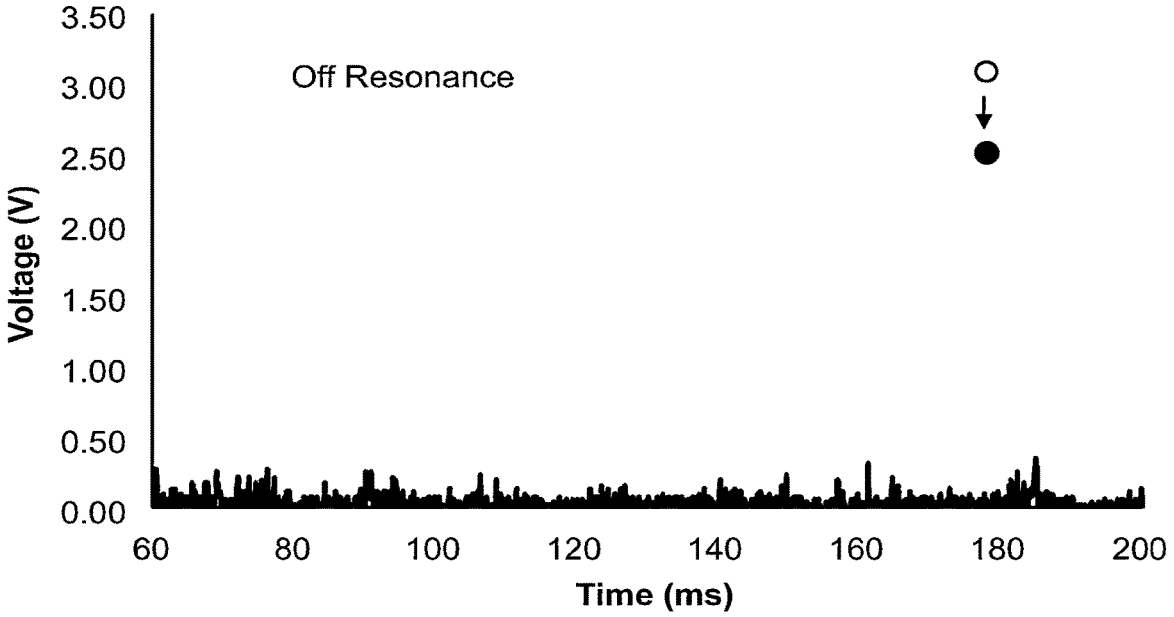
FIGS. 12A-C show precursor scans and secular frequency full mass scans performed on 10 ppm solutions of three illicit drugs (m/z 180, 194, and 304) ionized by nanoESI. In each experiment the frequency of an AC signal was scanned while superimposed on it was
Figure 12B:
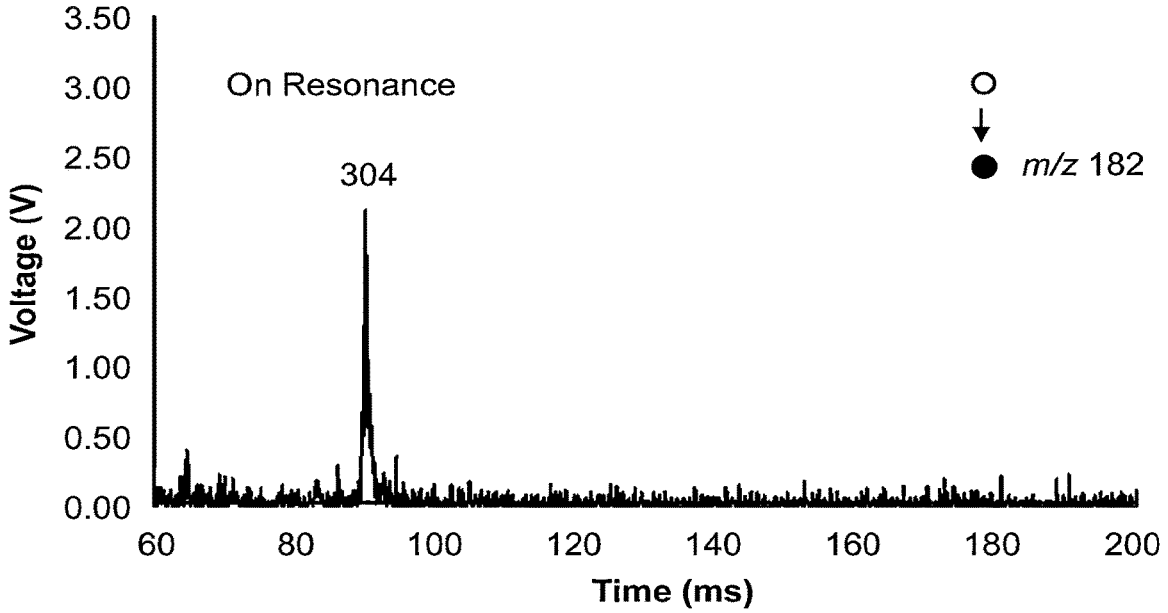
Figure 12C:
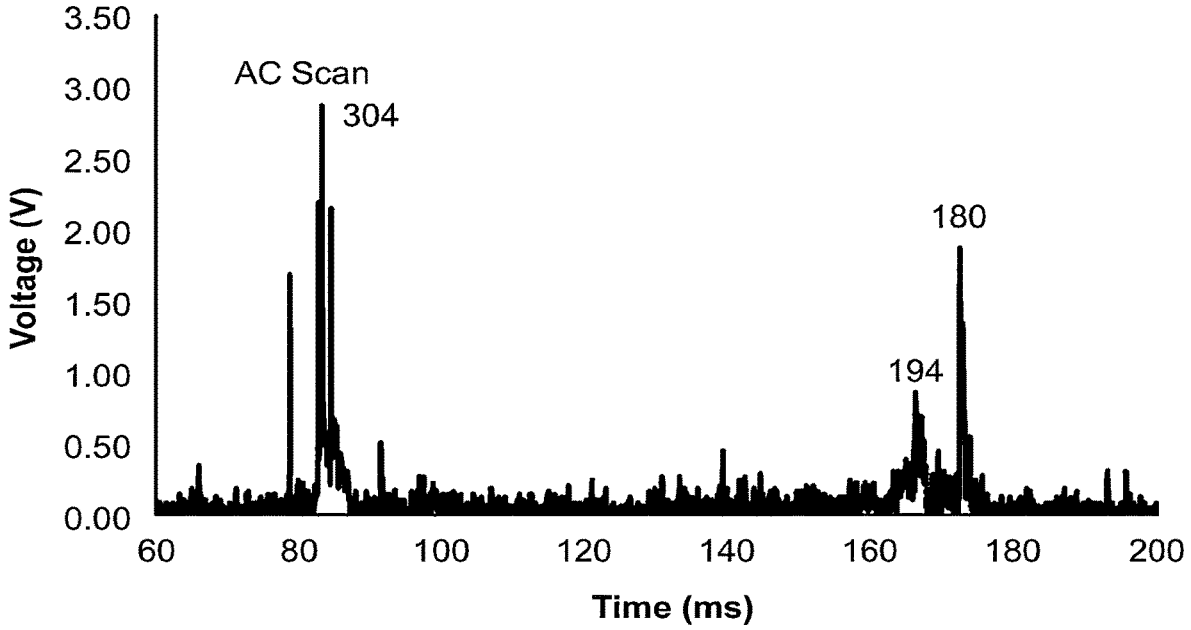
Figure 13A:
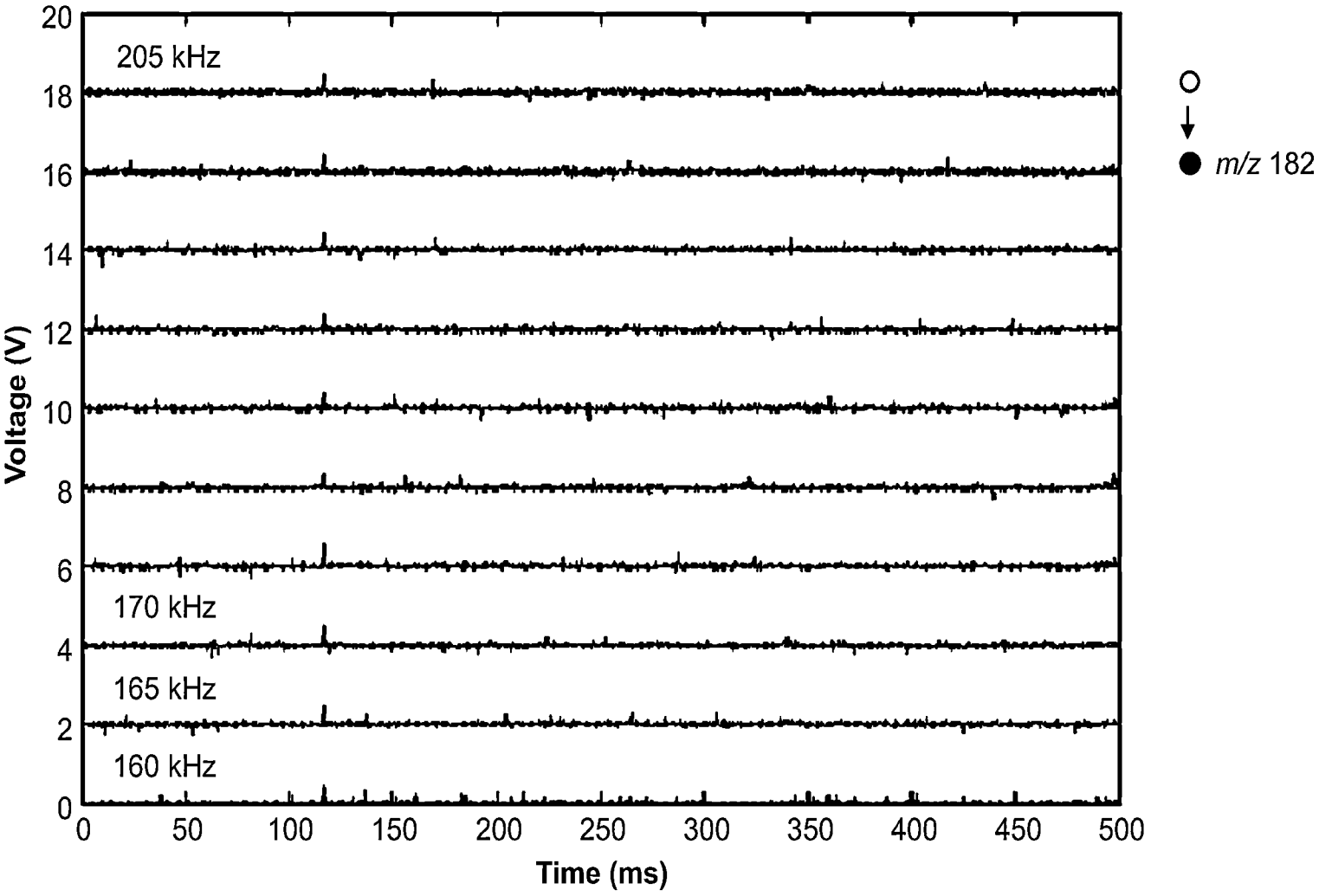
FIGS. 13A-D show precursor scans of cocaine (m/z 304) as a function of the constant ejection frequency. For reference, cocaine has a resonant frequency of 95 kHz and its product, m/z 182, has a resonant frequency of 153 kHz. Only when the frequency is at or near resonance with the fragment (indicated by squares, either the fundamental or a higher order resonance, e.g. 75 kHz) is cocaine detected.
Figure 13B:
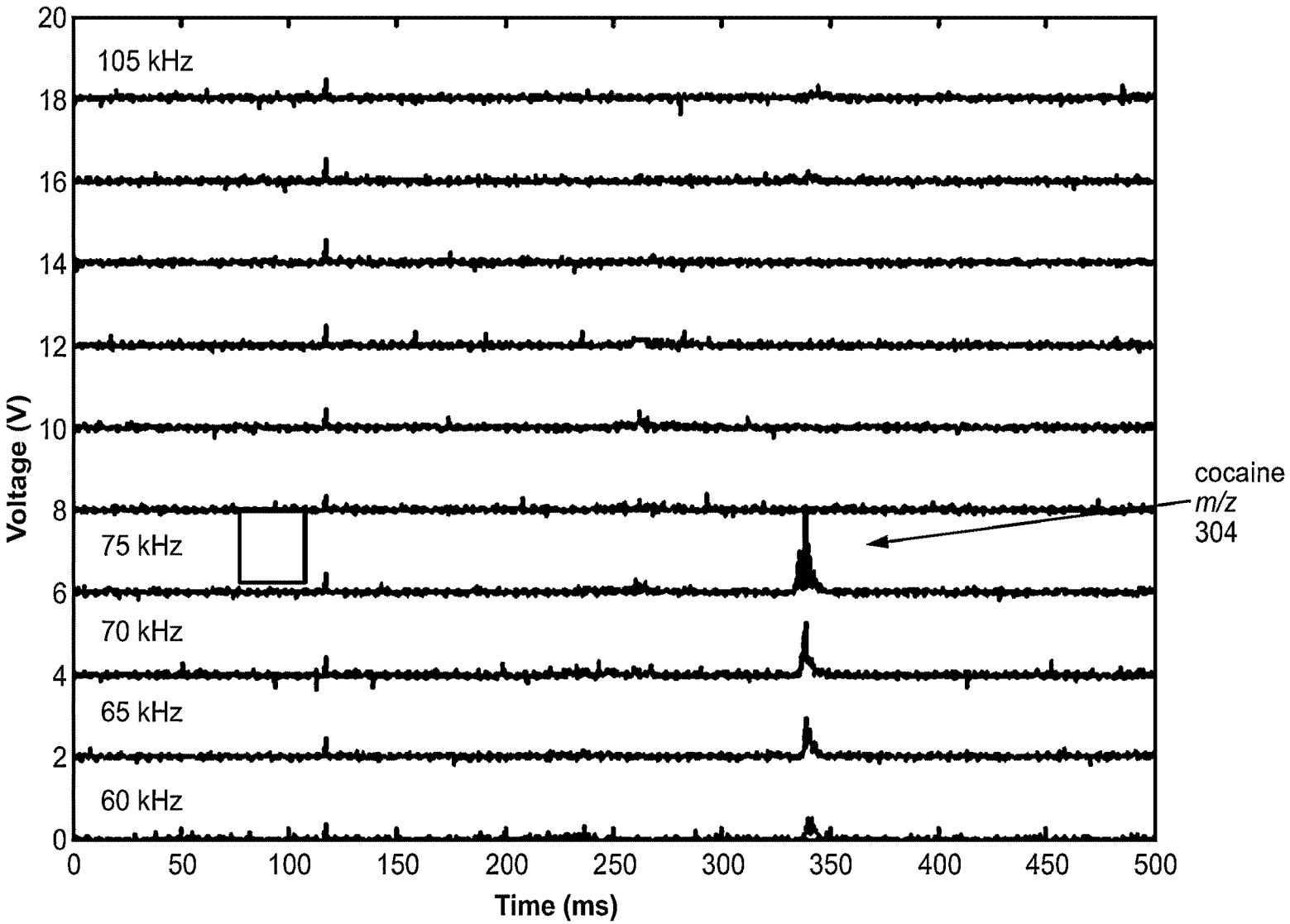
Figure 13C:
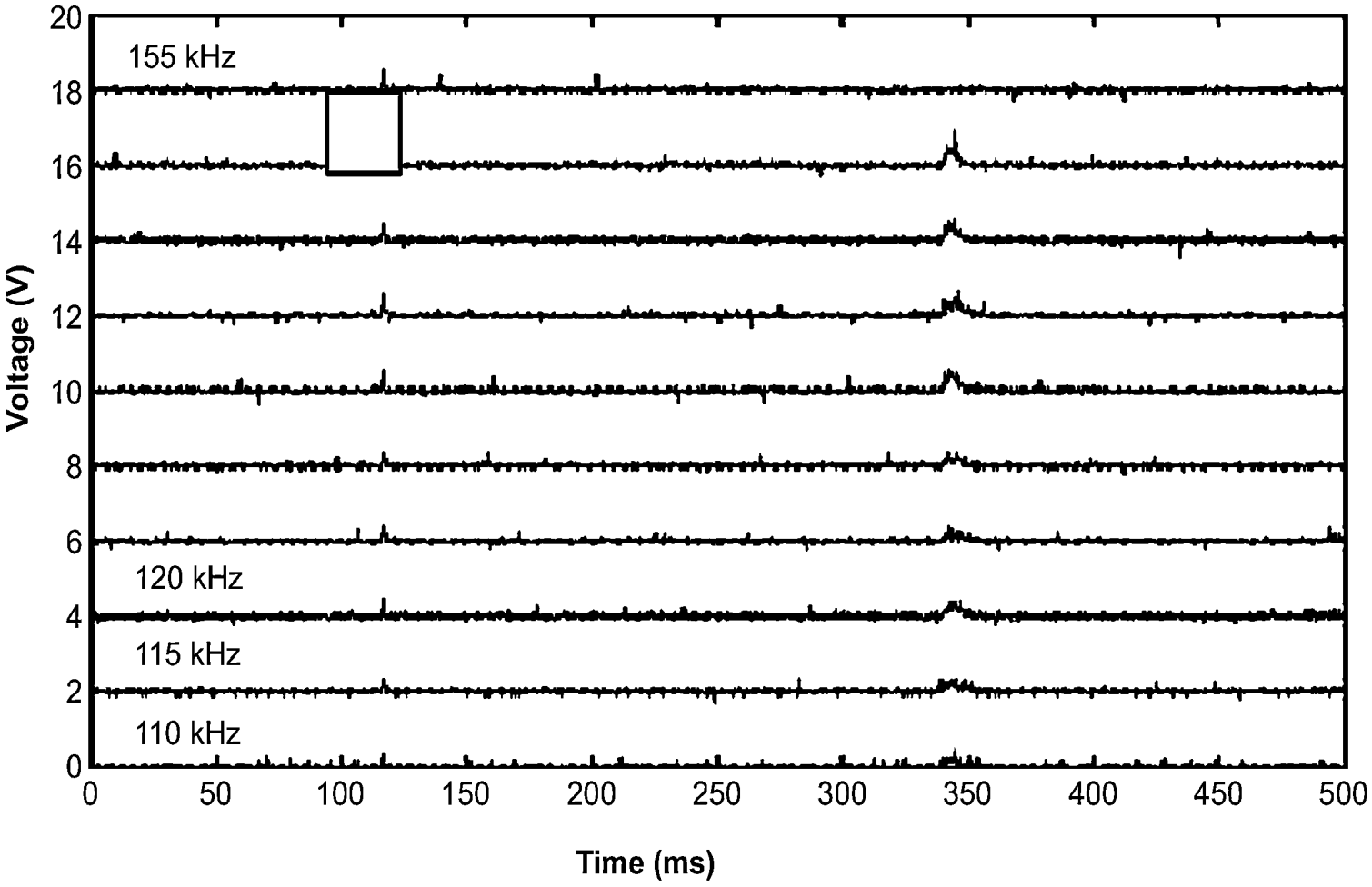
Figure 13D:
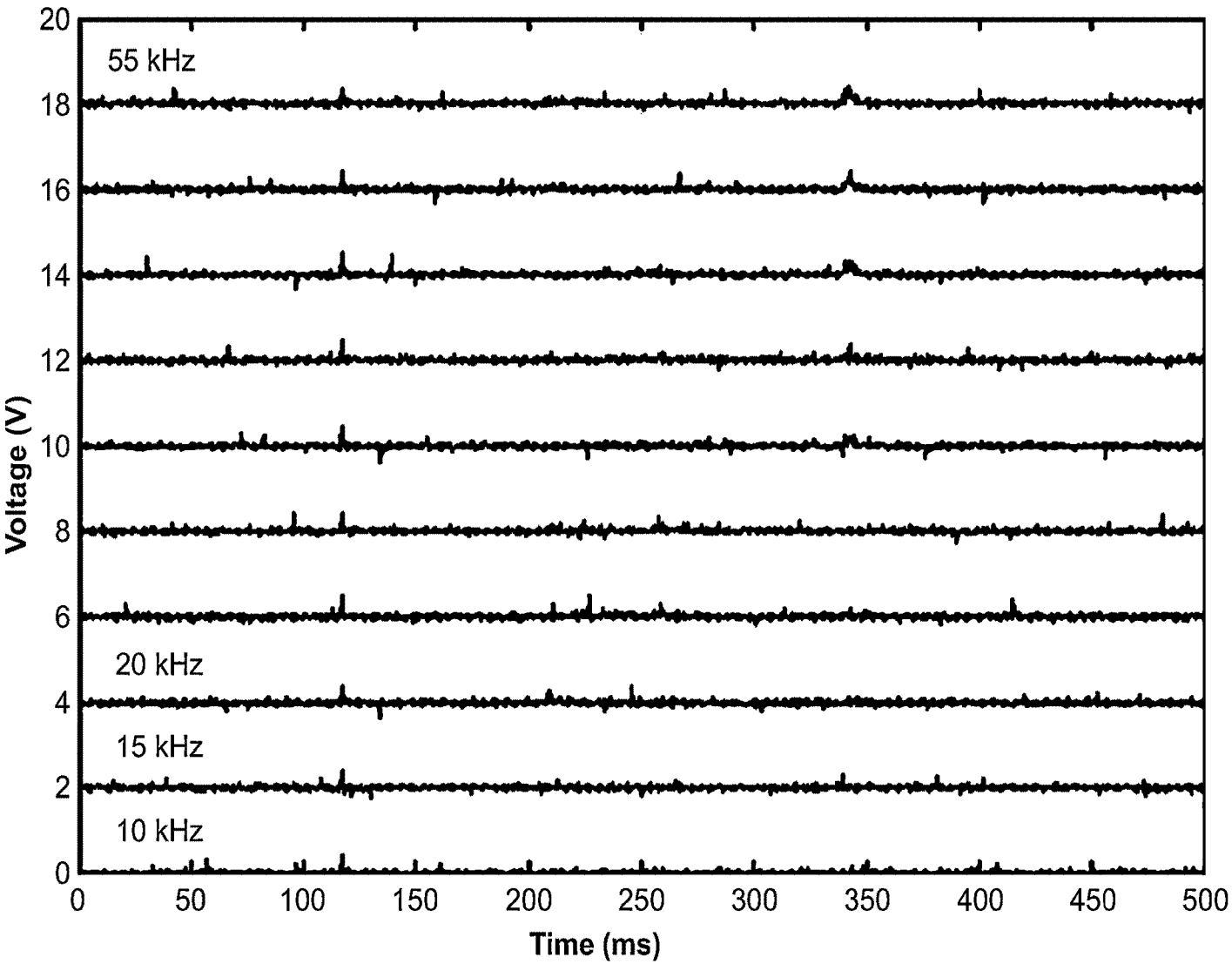

FIGS. 12A-C show data for a mixture of illicit drugs including cocaine ($MH^+$ m/z 304), 3,4-methylenedioxymethamphetamine ($MH^+$ m/z 194), and 3,4-methylenedioxyamphetamine ($MH^+$ m/z 180). When one AC signal is turned on and scanned (FIG. 12C) the mass spectrum is recorded and it shows all three drugs. When one AC is scanned but the second AC is set on a blank fragment mass (FIG. 12A), no signal is recorded. When the AC is again scanned and the fixed AC is set on m/z 182 (FIG. 12B), which is a product ion of cocaine, a signal is seen in the precursor scan corresponding to m/z 304→m/z 182. In other words CID gives rise to products when the on-resonance condition is met as the AC frequency is scanned through the value corresponding to the precursor ion m/z 304, while the product ion, m/z 182, is simultaneously being ejected.

FIGS. 13A-D show the precursor scan as a function of the frequency of the higher amplitude, fixed frequency waveform (for ejection of product ions). Only when the AC frequency matches a resonance frequency of the product of cocaine (150 kHz, as well as the higher order resonance at 75 kHz) is a signal detected.

Figure 14:
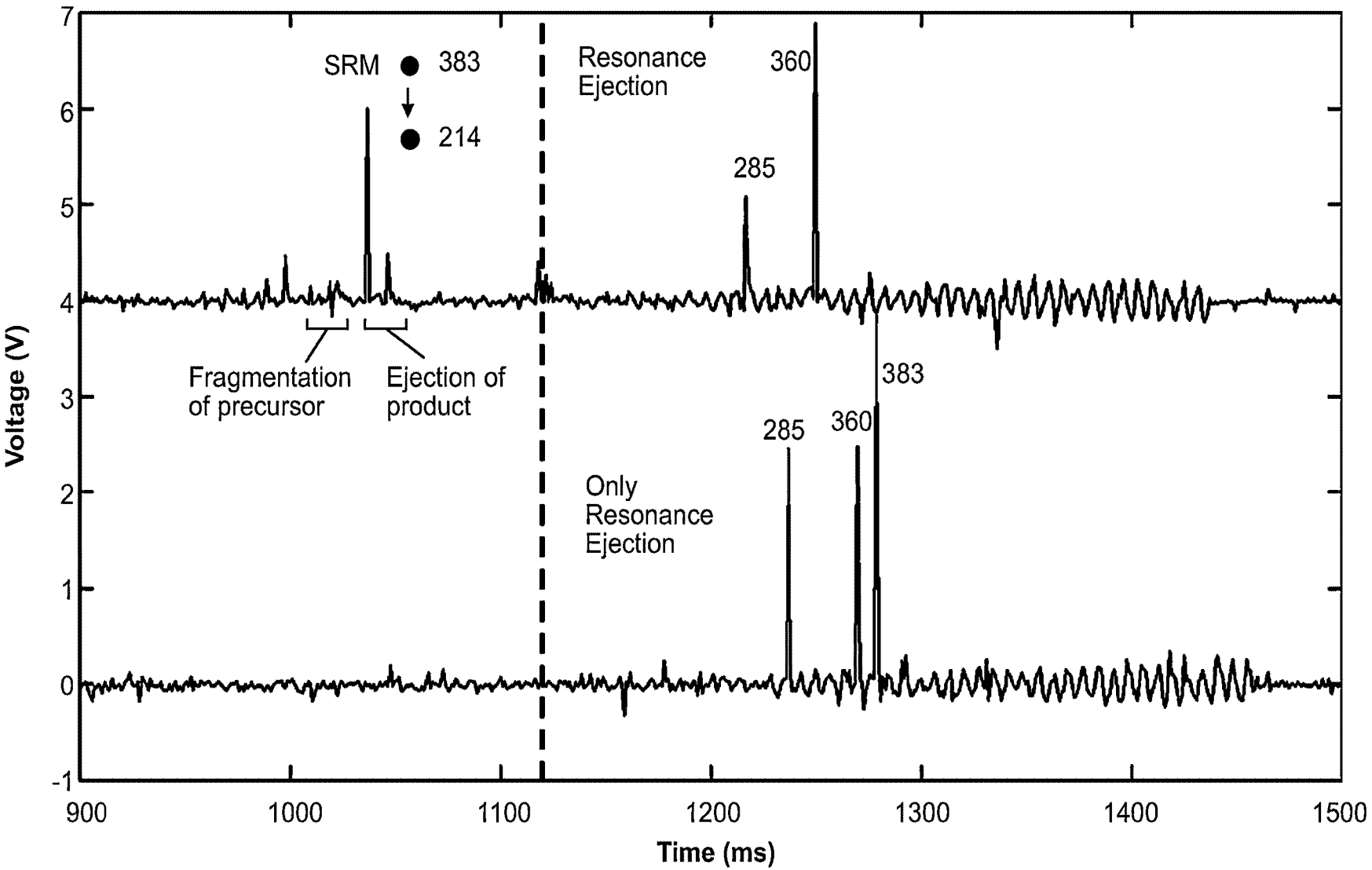
FIG. 14 shows two spectra of voltage (output from the Mini 12 current to voltage converter) versus time: the bottom spectrum demonstrates the classical resonance ejection scan of three tetraalkylammonium ions (m/z 285, 360, and 383) and the top shows a selected reaction monitoring experiment followed immediately by a resonance ejection scan for reference. The ion at m/z 383 was selectively fragmented by applying a short, low amplitude AC waveform at its secular frequency (75 kHz), and its product was subsequently ejected by another short AC waveform with a higher amplitude and at the product's secular frequency (135 kHz). The signal detected is thus from a selected reaction monitoring experiment; ions m/z 285 and 360 are not detected during the SRM experiment, but are instead detected when the remaining ions in the trap are scanned out via resonance ejection. Note that the resonance ejection scan begins at the dotted line.

FIG. 14 shows the results of two scans. In the bottom figure, only a resonance ejection mass spectrum of three tetraalkylammonium ions (m/z 285, 360, and 383) is recorded. The top spectrum shows a selected reaction monitoring experiment followed by a resonance ejection scan. The ion m/z 383 is mass selectively fragmented for ~10 ms by applying a short, low amplitude AC waveform at 75 kHz, and its fragment, m/z 214, is then ejected from the trap (and detected) by a larger amplitude AC waveform fixed at the product's secular frequency (135 kHz). A resonance ejection scan (beginning at the dotted line) is then performed for reference, showing that neither m/z 285 nor m/z 360 were ejected or fragmented and were thus scanned out during resonance ejection. The peak at m/z 383 does not appear since it was previously fragmented and its product detected.

Ion Traps and Mass Spectrometers

Any ion trap known in the art can be used in systems of the invention. Exemplary ion traps include a hyperbolic ion trap (e.g., U.S. Pat. No. 5,644,131, the content of which is incorporated by reference herein in its entirety), a cylindrical ion trap (e.g., Bonner et al., International Journal of Mass Spectrometry and Ion Physics, 24(3):255-269, 1977, the content of which is incorporated by reference herein in its entirety), a linear ion trap (Hagar, Rapid Communications in Mass Spectrometry, 16(6):512-526, 2002, the content of which is incorporated by reference herein in its entirety), and a rectilinear ion trap (U.S. Pat. No. 6,838,666, the content of which is incorporated by reference herein in its entirety).

Any mass spectrometer (e.g., bench-top mass spectrometer of miniature mass spectrometer) may be used in systems of the invention and in certain embodiments the mass spectrometer is a miniature mass spectrometer. An exemplary miniature mass spectrometer is described, for example in Gao et al. (Anal. Chem. 2008, 80, 7198-7205.), the content of which is incorporated by reference herein in its entirety. In comparison with the pumping system used for lab-scale instruments with thousands of watts of power, miniature mass spectrometers generally have smaller pumping systems, such as a 18 W pumping system with only a 5 L/min (0.3 $m^3$/hr) diaphragm pump and a 11 L/s turbo pump for the system described in Gao et al. Other exemplary miniature mass spectrometers are described for example in Gao et al. (Anal. Chem., 2008, 80, 7198-7205.), Hou et al. (Anal. Chem., 2011, 83, 1857-1861.), and Sokol et al. (Int. J. Mass Spectrom., 2011, 306, 187-195), the content of each of which is incorporated herein by reference in its entirety.

Ionization Sources

In certain embodiments, the systems of the invention include an ionizing source, which can be any type of ionizing source known in the art. Exemplary mass spectrometry techniques that utilize ionization sources at atmospheric pressure for mass spectrometry include paper spray ionization (ionization using wetted porous material, Ouyang et al., U.S. patent application publication number 2012/0119079), electrospray ionization (ESI; Fenn et al., Science, 1989, 246, 64-71; and Yamashita et al., J. Phys. Chem., 1984, 88, 4451-4459.); atmospheric pressure ionization (APCI; Carroll et al., Anal. Chem. 1975, 47, 2369-2373); and atmospheric pressure matrix assisted laser desorption ionization (AP-MALDI; Laiko et al. Anal. Chem., 2000, 72, 652-657; and Tanaka et al. Rapid Commun. Mass Spectrom., 1988, 2, 151-153,). The content of each of these references is incorporated by reference herein in its entirety.

Exemplary mass spectrometry techniques that utilize direct ambient ionization/sampling methods include desorption electrospray ionization (DESI; Takats et al., Science, 2004, 306, 471-473, and U.S. Pat. No. 7,335,897); direct analysis in real time (DART; Cody et al., Anal. Chem., 2005, 77, 2297-2302.); atmospheric pressure dielectric barrier discharge Ionization (DBDI; Kogelschatz, Plasma Chemistry and Plasma Processing, 2003, 23, 1-46, and PCT international publication number WO 2009/102766), and electrospray-assisted laser desorption/ionization (ELDI; Shiea et al., J. Rapid Communications in Mass Spectrometry, 2005, 19, 3701-3704.). The content of each of these references in incorporated by reference herein its entirety.

System Architecture

Figure 15:
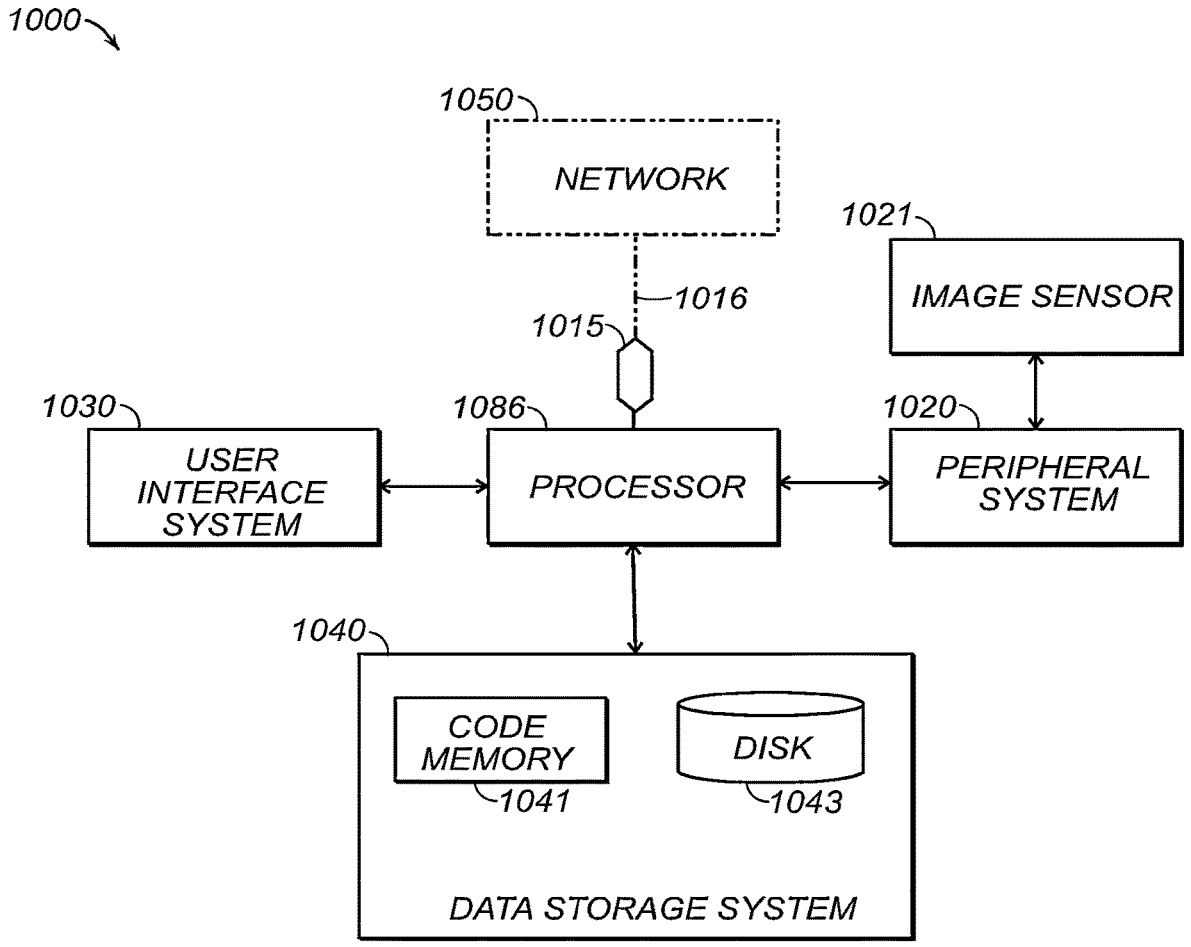
FIG. 15 shows a high-level diagram of the components of an exemplary data-processing system for analyzing data and performing other analyses described herein, and related components.

FIG. 15 is a high-level diagram showing the components of an exemplary data-processing system 1000 for analyzing data and performing other analyses described herein, and related components. The system includes a processor 1086, a peripheral system 1020, a user interface system 1030, and a data storage system 1040. The peripheral system 1020, the user interface system 1030 and the data storage system 1040 are communicatively connected to the processor 1086. Processor 1086 can be communicatively connected to network 1050 (shown in phantom), e.g., the Internet or a leased line, as discussed below. The data described above may be obtained using detector 1021 and/or displayed using display units (included in user interface system 1030) which can each include one or more of systems 1086, 1020, 1030, 1040, and can each connect to one or more network(s) 1050. Processor 1086, and other processing devices described herein, can each include one or more microprocessors, microcontrollers, field-programmable gate arrays (FPGAs), application-specific integrated circuits (ASICs), programmable logic devices (PLDs), programmable logic arrays (PLAs), programmable array logic devices (PALs), or digital signal processors (DSPs).

Processor 1086 which in one embodiment may be capable of real-time calculations (and in an alternative embodiment configured to perform calculations on a non-real-time basis and store the results of calculations for use later) can implement processes of various aspects described herein. Processor 1086 can be or include one or more device(s) for automatically operating on data, e.g., a central processing unit (CPU), microcontroller (MCU), desktop computer, laptop computer, mainframe computer, personal digital assistant, digital camera, cellular phone, smartphone, or any other device for processing data, managing data, or handling data, whether implemented with electrical, magnetic, optical, biological components, or otherwise. The phrase "communicatively connected" includes any type of connection, wired or wireless, for communicating data between devices or processors. These devices or processors can be located in physical proximity or not. For example, subsystems such as peripheral system 1020, user interface system 1030, and data storage system 1040 are shown separately from the data processing system 1086 but can be stored completely or partially within the data processing system 1086.

The peripheral system 1020 can include one or more devices configured to provide digital content records to the processor 1086. For example, the peripheral system 1020 can include digital still cameras, digital video cameras, cellular phones, or other data processors. The processor 1086, upon receipt of digital content records from a device in the peripheral system 1020, can store such digital content records in the data storage system 1040.

The user interface system 1030 can include a mouse, a keyboard, another computer (e.g., a tablet) connected, e.g., via a network or a null-modem cable, or any device or combination of devices from which data is input to the processor 1086. The user interface system 1030 also can include a display device, a processor-accessible memory, or any device or combination of devices to which data is output by the processor 1086. The user interface system 1030 and the data storage system 1040 can share a processor-accessible memory.

In various aspects, processor 1086 includes or is connected to communication interface 1015 that is coupled via network link 1016 (shown in phantom) to network 1050. For example, communication interface 1015 can include an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM. Communication interface 1015 sends and receives electrical, electromagnetic or optical signals that carry digital or analog data streams representing various types of information across network link 1016 to network 1050. Network link 1016 can be connected to network 1050 via a switch, gateway, hub, router, or other networking device.

Processor 1086 can send messages and receive data, including program code, through network 1050, network link 1016 and communication interface 1015. For example, a server can store requested code for an application program (e.g., a JAVA applet) on a tangible non-volatile computer-readable storage medium to which it is connected. The server can retrieve the code from the medium and transmit it through network 1050 to communication interface 1015. The received code can be executed by processor 1086 as it is received, or stored in data storage system 1040 for later execution.

Data storage system 1040 can include or be communicatively connected with one or more processor-accessible memories configured to store information. The memories can be, e.g., within a chassis or as parts of a distributed system. The phrase "processor-accessible memory" is intended to include any data storage device to or from which processor 1086 can transfer data (using appropriate components of peripheral system 1020), whether volatile or non-volatile; removable or fixed; electronic, magnetic, optical, chemical, mechanical, or otherwise. Exemplary processor-accessible memories include but are not limited to: registers, floppy disks, hard disks, tapes, bar codes, Compact Discs, DVDs, read-only memories (ROM), Universal Serial Bus (USB) interface memory device, erasable programmable read-only memories (EPROM, EEPROM, or Flash), remotely accessible hard drives, and random-access memories (RAMs). One of the processor-accessible memories in the data storage system 1040 can be a tangible non-transitory computer-readable storage medium, i.e., a non-transitory device or article of manufacture that participates in storing instructions that can be provided to processor 1086 for execution.

In an example, data storage system 1040 includes code memory 1041, e.g., a RAM, and disk 1043, e.g., a tangible computer-readable rotational storage device such as a hard drive. Computer program instructions are read into code memory 1041 from disk 1043. Processor 1086 then executes one or more sequences of the computer program instructions loaded into code memory 1041, as a result performing process steps described herein. In this way, processor 1086 carries out a computer implemented process. For example, steps of methods described herein, blocks of the flowchart illustrations or block diagrams herein, and combinations of those, can be implemented by computer program instructions. Code memory 1041 can also store data, or can store only code.

Various aspects described herein may be embodied as systems or methods. Accordingly, various aspects herein may take the form of an entirely hardware aspect, an entirely software aspect (including firmware, resident software, micro-code, etc.), or an aspect combining software and hardware aspects. These aspects can all generally be referred to herein as a "service," "circuit," "circuitry," "module," or "system."

Furthermore, various aspects herein may be embodied as computer program products including computer readable program code stored on a tangible non-transitory computer readable medium. Such a medium can be manufactured as is conventional for such articles, e.g., by pressing a CD-ROM. The program code includes computer program instructions that can be loaded into processor 1086 (and possibly also other processors) to cause functions, acts, or operational steps of various aspects herein to be performed by the processor 1086 (or other processor). Computer program code for carrying out operations for various aspects described herein may be written in any combination of one or more programming language(s), and can be loaded from disk 1043 into code memory 1041 for execution. The program code may execute, e.g., entirely on processor 1086, partly on processor 1086 and partly on a remote computer connected to network 1050, or entirely on the remote computer.

Discontinuous Atmospheric Pressure Interface (DAPI)

In certain embodiments, the systems of the invention can be operated with a Discontinuous Atmospheric Pressure Interface (DAPI). A DAPI is particularly useful when coupled to a miniature mass spectrometer, but can also be used with a standard bench-top mass spectrometer. Discontinuous atmospheric interfaces are described in Ouyang et al. (U.S. Pat. No. 8,304,718 and PCT application number PCT/US2008/065245), the content of each of which is incorporated by reference herein in its entirety.

Figure 16:
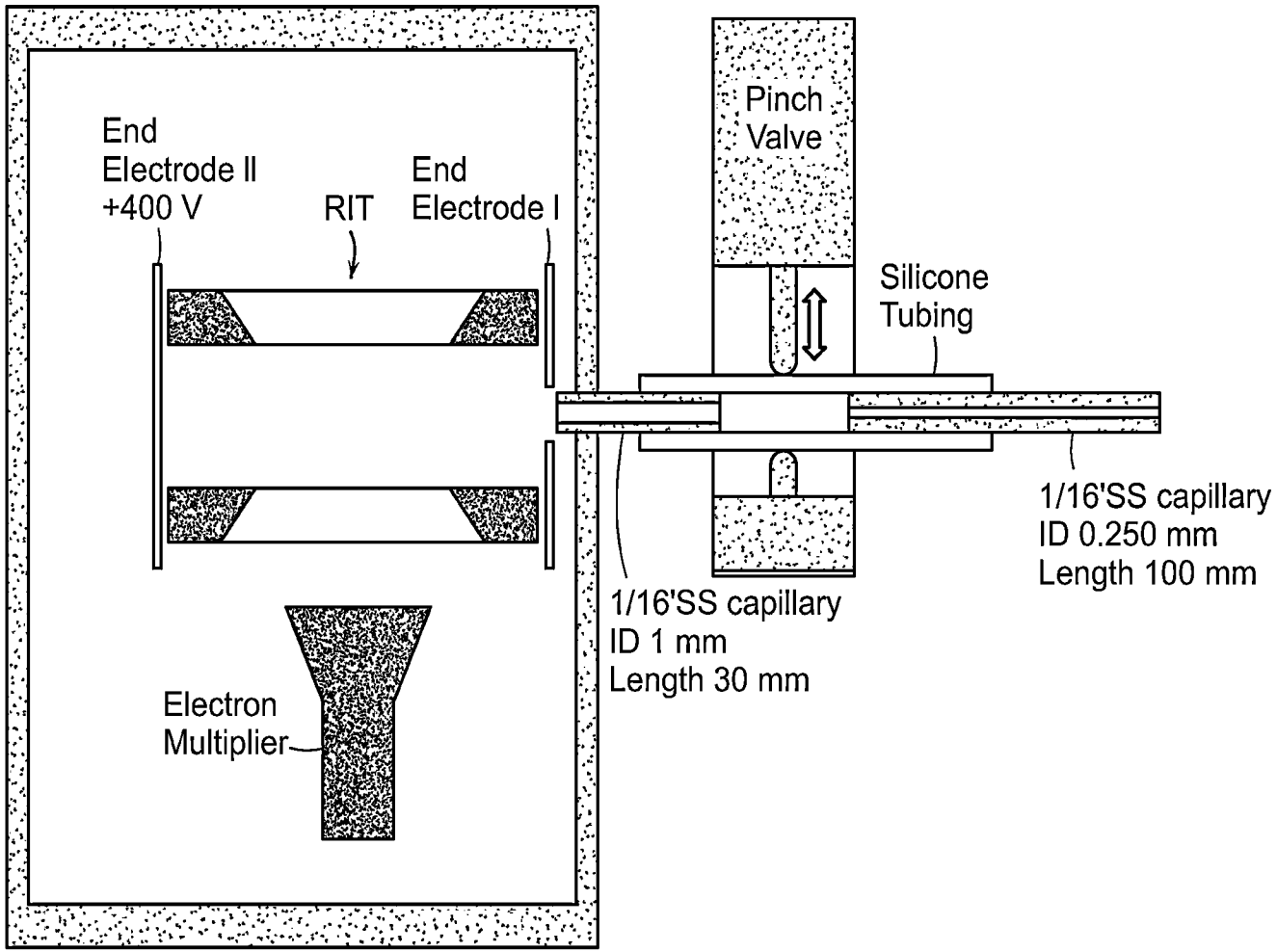
FIG. 16 shows a schematic showing a discontinuous atmospheric pressure interface coupled to a miniature mass spectrometer with rectilinear ion trap.
Figure 17:
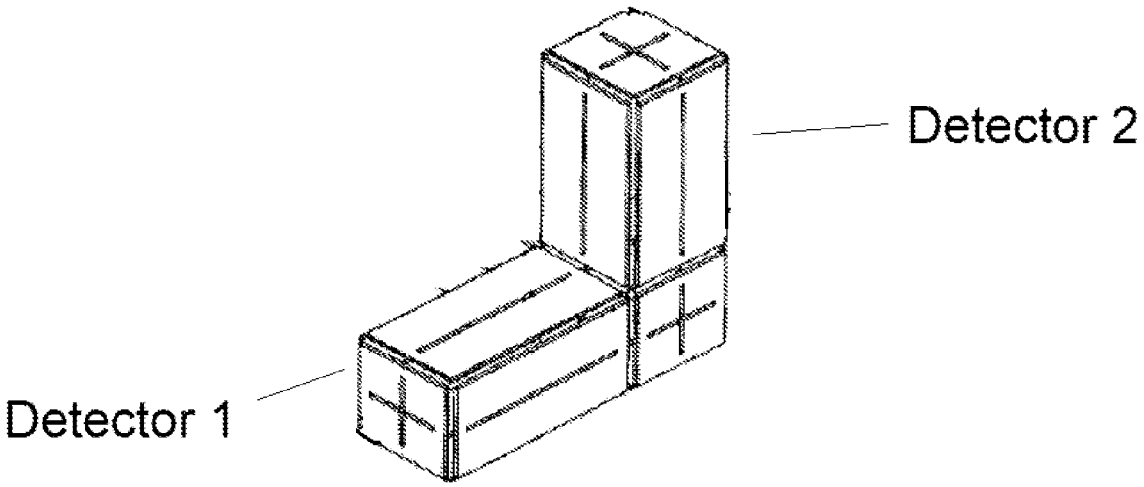
FIG. 17 shows a second detector of a mass spectrometer is positioned orthogonal to a first detector of the mass spectrometer.

An exemplary DAPI is shown in FIG. 16. The concept of the DAPI is to open its channel during ion introduction and then close it for subsequent mass analysis during each scan. An ion transfer channel with a much bigger flow conductance can be allowed for a DAPI than for a traditional continuous API. The pressure inside the manifold temporarily increases significantly when the channel is opened for maximum ion introduction. All high voltages can be shut off and only low voltage RF is on for trapping of the ions during this period. After the ion introduction, the channel is closed and the pressure can decrease over a period of time to reach the optimal pressure for further ion manipulation or mass analysis when the high voltages can be is turned on and the RF can be scanned to high voltage for mass analysis.

A DAPI opens and shuts down the airflow in a controlled fashion. The pressure inside the vacuum manifold increases when the API opens and decreases when it closes. The combination of a DAPI with a trapping device, which can be a mass analyzer or an intermediate stage storage device, allows maximum introduction of an ion package into a system with a given pumping capacity.

Much larger openings can be used for the pressure constraining components in the API in the new discontinuous introduction mode. During the short period when the API is opened, the ion trapping device is operated in the trapping mode with a low RF voltage to store the incoming ions; at the same time the high voltages on other components, such as conversion dynode or electron multiplier, are shut off to avoid damage to those device and electronics at the higher pressures. The API can then be closed to allow the pressure inside the manifold to drop back to the optimum value for mass analysis, at which time the ions are mass analyzed in the trap or transferred to another mass analyzer within the vacuum system for mass analysis. This two-pressure mode of operation enabled by operation of the API in a discontinuous fashion maximizes ion introduction as well as optimizing conditions for the mass analysis with a given pumping capacity.

The design goal is to have largest opening while keeping the optimum vacuum pressure for the mass analyzer, which is between 10−3 to 10−10 torr depending the type of mass analyzer. The larger the opening in an atmospheric pressure interface, the higher is the ion current delivered into the vacuum system and hence to the mass analyzer.

An exemplary embodiment of a DAPI is described herein. The DAPI includes a pinch valve that is used to open and shut off a pathway in a silicone tube connecting regions at atmospheric pressure and in vacuum. A normally-closed pinch valve (390NC24330, ASCO Valve Inc., Florham Park, N.J.) is used to control the opening of the vacuum manifold to atmospheric pressure region. Two stainless steel capillaries are connected to the piece of silicone plastic tubing, the open/closed status of which is controlled by the pinch valve. The stainless steel capillary connecting to the atmosphere is the flow restricting element, and has an ID of 250 μm, an OD of 1.6 mm (1/16") and a length of 10 cm. The stainless steel capillary on the vacuum side has an ID of 1.0 mm, an OD of 1.6 mm (1/16") and a length of 5.0 cm. The plastic tubing has an ID of 1/16", an OD of 1/8" and a length of 5.0 cm. Both stainless steel capillaries are grounded. The pumping system of the mini 10 consists of a two-stage diaphragm pump 1091-N84.0-8.99 (KNF Neuberger Inc., Trenton, N.J.) with pumping speed of 5 L/min (0.3 m3/hr) and a TPD011 hybrid turbomolecular pump (Pfeiffer Vacuum Inc., Nashua, N.H.) with a pumping speed of 11 L/s.

When the pinch valve is constantly energized and the plastic tubing is constantly open, the flow conductance is so high that the pressure in vacuum manifold is above 30 torr with the diaphragm pump operating. The ion transfer efficiency was measured to be 0.2%, which is comparable to a lab-scale mass spectrometer with a continuous API. However, under these conditions the TPD 011 turbomolecular pump cannot be turned on. When the pinch valve is de-energized, the plastic tubing is squeezed closed and the turbo pump can then be turned on to pump the manifold to its ultimate pressure in the range of 1×10 5 torr.

The sequence of operations for performing mass analysis using ion traps usually includes, but is not limited to, ion introduction, ion cooling and AC scanning as described herein. After the manifold pressure is pumped down initially, a scan function is implemented to switch between open and closed modes for ion introduction and mass analysis. During the ionization time, a 24 V DC is used to energize the pinch valve and the API is open. The potential on the rectilinear ion trap (RIT) end electrode is also set to ground during this period. A minimum response time for the pinch valve is found to be 10 ms and an ionization time between 15 ms and 30 ms is used for the characterization of the discontinuous API. A cooling time between 250 ms to 500 ms is implemented after the API is closed to allow the pressure to decrease and the ions to cool down via collisions with background air molecules. The high voltage on the electron multiplier is then turned on and the AC voltage is scanned for mass analysis. During the operation of the discontinuous API, the pressure change in the manifold can be monitored using the micro pirani vacuum gauge (MKS 925C, MKS Instruments, Inc. Wilmington, Mass.) on Mini 10.

Sample Analysis

Another aspect of the invention provides methods for analyzing a sample using mass spectrometry systems that include ion traps of the invention. The methods involve ionizing a sample to generate precursor ions that are introduced into a single ion trap of a mass spectrometer. At least two signals are applied to the single ion trap in a manner that excites at least one of the precursor ions and ejects a product ion in the single ion trap. Ejected product ions from the ion trap are received at a detector where the product ions are analyzed. Typically, a mass spectrum is produced or mass spectra are produced and they are analyzed. The analysis can be comparing the sample spectrum against a reference spectrum or by simply analyzing the spectrum for the presence of certain peaks that are indicative of certain analytes in the sample. Exemplary analysis methods are shown for example in U.S. Pat. No. 9,157,921 and U.S. patent application publication number 2013/0273560, the content of each of which is incorporated by reference herein in its entirety.

A wide range of heterogeneous samples can be analyzed, such as biological samples, environmental samples (including, e.g., industrial samples and agricultural samples), and food/beverage product samples, etc.

Exemplary environmental samples include, but are not limited to, groundwater, surface water, saturated soil water, unsaturated soil water; industrialized processes such as waste water, cooling water; chemicals used in a process, chemical reactions in an industrial processes, and other systems that would involve leachate from waste sites; waste and water injection processes; liquids in or leak detection around storage tanks; discharge water from industrial facilities, water treatment plants or facilities; drainage and leachates from agricultural lands, drainage from urban land uses such as surface, subsurface, and sewer systems; waters from waste treatment technologies; and drainage from mineral extraction or other processes that extract natural resources such as oil production and in situ energy production.

Additionally exemplary environmental samples include, but certainly are not limited to, agricultural samples such as crop samples, such as grain and forage products, such as soybeans, wheat, and corn. Often, data on the constituents of the products, such as moisture, protein, oil, starch, amino acids, extractable starch, density, test weight, digestibility, cell wall content, and any other constituents or properties that are of commercial value is desired.

Exemplary biological samples include a human tissue or bodily fluid and may be collected in any clinically acceptable manner. A tissue is a mass of connected cells and/or extracellular matrix material, e.g. skin tissue, hair, nails, nasal passage tissue, CNS tissue, neural tissue, eye tissue, liver tissue, kidney tissue, placental tissue, mammary gland tissue, placental tissue, mammary gland tissue, gastrointestinal tissue, musculoskeletal tissue, genitourinary tissue, bone marrow, and the like, derived from, for example, a human or other mammal and includes the connecting material and the liquid material in association with the cells and/or tissues. A body fluid is a liquid material derived from, for example, a human or other mammal. Such body fluids include, but are not limited to, mucous, blood, plasma, serum, serum derivatives, bile, blood, maternal blood, phlegm, saliva, sputum, sweat, amniotic fluid, menstrual fluid, mammary fluid, peritoneal fluid, urine, semen, and cerebrospinal fluid (CSF), such as lumbar or ventricular CSF. A sample may also be a fine needle aspirate or biopsied tissue. A sample also may be media containing cells or biological material. A sample may also be a blood clot, for example, a blood clot that has been obtained from whole blood after the serum has been removed.

In one embodiment, the biological sample can be a blood sample, from which plasma or serum can be extracted. The blood can be obtained by standard phlebotomy procedures and then separated. Typical separation methods for preparing a plasma sample include centrifugation of the blood sample. For example, immediately following blood draw, protease inhibitors and/or anticoagulants can be added to the blood sample. The tube is then cooled and centrifuged, and can subsequently be placed on ice. The resultant sample is separated into the following components: a clear solution of blood plasma in the upper phase; the buffy coat, which is a thin layer of leukocytes mixed with platelets; and erythrocytes (red blood cells). Typically, 8.5 mL of whole blood will yield about 2.5-3.0 mL of plasma.

Blood serum is prepared in a very similar fashion. Venous blood is collected, followed by mixing of protease inhibitors and coagulant with the blood by inversion. The blood is allowed to clot by standing tubes vertically at room temperature. The blood is then centrifuged, wherein the resultant supernatant is the designated serum. The serum sample should subsequently be placed on ice.

Prior to analyzing a sample, the sample may be purified, for example, using filtration or centrifugation. These techniques can be used, for example, to remove particulates and chemical interference. Various filtration media for removal of particles includes filer paper, such as cellulose and membrane filters, such as regenerated cellulose, cellulose acetate, nylon, PTFE, polypropylene, polyester, polyethersulfone, polycarbonate, and polyvinylpyrolidone. Various filtration media for removal of particulates and matrix interferences includes functionalized membranes, such as ion exchange membranes and affinity membranes; SPE cartridges such as silica- and polymer-based cartridges; and SPE (solid phase extraction) disks, such as PTFE- and fiberglass-based. Some of these filters can be provided in a disk format for loosely placing in filter holdings/housings, others are provided within a disposable tip that can be placed on, for example, standard blood collection tubes, and still others are provided in the form of an array with wells for receiving pipetted samples. Another type of filter includes spin filters. Spin filters consist of polypropylene centrifuge tubes with cellulose acetate filter membranes and are used in conjunction with centrifugation to remove particulates from samples, such as serum and plasma samples, typically diluted in aqueous buffers.

Filtration is affected in part, by porosity values, such that larger porosities filter out only the larger particulates and smaller porosities filtering out both smaller and larger porosities. Typical porosity values for sample filtration are the 0.20 and 0.45 μm porosities. Samples containing colloidal material or a large amount of fine particulates, considerable pressure may be required to force the liquid sample through the filter. Accordingly, for samples such as soil extracts or wastewater, a prefilter or depth filter bed (e.g. "2-in-1" filter) can be used and which is placed on top of the membrane to prevent plugging with samples containing these types of particulates.

In some cases, centrifugation without filters can be used to remove particulates, as is often done with urine samples. For example, the samples are centrifuged. The resultant supernatant is then removed and frozen.

After a sample has been obtained and purified, the sample can be analyzed to determine the concentration of one or more target analytes, such as elements within a blood plasma sample. With respect to the analysis of a blood plasma sample, there are many elements present in the plasma, such as proteins (e.g., Albumin), ions and metals (e.g., iron), vitamins, hormones, and other elements (e.g., bilirubin and uric acid). Any of these elements may be detected using methods of the invention. More particularly, methods of the invention can be used to detect molecules in a biological sample that are indicative of a disease state.

INCORPORATION BY REFERENCE

References and citations to other documents, such as patents, patent applications, patent publications, journals, books, papers, and web contents have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A system comprising:

a mass spectrometer comprising a single rectilinear ion trap; and a central processing unit (CPU), and storage coupled to the CPU and storing instructions that when executed by the CPU cause the system to apply to the single ion trap a constant alternating current (AC) frequency and ramping a radio frequency (RF) voltage in a reverse direction in order to excite a precursor ion and eject a product ion in the single ion trap, wherein the excitation of the precursor ion occurs through application of at least two signals to the single ion trap and the ejection of the product ion occurs through simultaneous application of a third signal to the ion trap, and wherein a second detector of a mass spectrometer is positioned orthogonal to a first detector of the mass spectrometer such that ions made unstable by the second AC signal and are ejected from the ion trap and received at the second detector.

2. The system according to claim 1, wherein the third signal comprises a variable frequency that results in ejection of the corresponding product ion from the ion trap.

3. The system according to claim 1, wherein the product ion has a neutral loss and the third signal is configured to scan a frequency of the product ion at a constant mass offset from the precursor ion that corresponds to the neutral loss.

* * * * *